US010935219B2

(12) United States Patent
Winters et al.

(10) Patent No.: US 10,935,219 B2
(45) **Date of Patent: *Mar. 2, 2021**

(54) SURFACE MOUNT LUMINAIRE

(71) Applicant: SIGNIFY HOLDING B.V., Eindhoven (NL)

(72) Inventors: Philip D. Winters, Senoia, GA (US); Jyoti Kumar, Tyrone, GA (US)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 16/797,341

(22) Filed: Feb. 21, 2020

(65) Prior Publication Data

US 2020/0191364 A1 Jun. 18, 2020

Related U.S. Application Data

(63) Continuation of application No. 15/958,667, filed on Apr. 20, 2018, now Pat. No. 10,571,099.

(51) Int. Cl.

| | |
|---|---|
| ***F21V 21/04*** | (2006.01) |
| ***F21V 5/04*** | (2006.01) |
| ***F21V 15/01*** | (2006.01) |
| ***F21V 31/00*** | (2006.01) |

(52) U.S. Cl.

CPC ..... *F21V 21/04* (2013.01); *F21V 5/04* (2013.01); *F21V 15/01* (2013.01); *F21V 31/005* (2013.01)

(58) Field of Classification Search

CPC . F21V 5/04; F21V 15/01; F21V 21/00; F21V 21/02; F21V 21/04–049; F21V 31/00; F21V 31/005

USPC ..... 362/147–150, 217.01–217.17, 218–225, 362/249.02–249.05, 267, 368, 374–375, 362/404, 457, 800

See application file for complete search history.

(56) References Cited

U.S. PATENT DOCUMENTS

| | | | | |
|---|---|---|---|---|
| 8,353,611 | B2 | 1/2013 | Truesdale | |
| 9,028,086 | B2 * | 5/2015 | Woo | F21V 7/04 362/294 |
| 9,857,050 | B2 | 1/2018 | Bobbo | |
| 10,072,833 | B2 * | 9/2018 | Ng | F21V 29/70 |
| 2005/0200495 | A1 | 9/2005 | Sibalich | |

* cited by examiner

*Primary Examiner* — Jason M Han

(57) ABSTRACT

A surface mount luminaire includes a housing assembly formed by a light source housing and a housing cover that are removably coupled to each other. The light source housing includes a recessed structure that defines an inner cavity. The inner cavity houses a lighting assembly that is configured to emit light to an area that is to be illuminated. Further, the light source housing defines a second cavity that is disposed external to and around the recessed structure. The second cavity is enclosed by the housing cover and houses electrical components associated with the luminaire such that the electrical components are inset within the housing assembly of the luminaire. Further, the luminaire includes one or more gaskets that are coupled to the housing assembly to provide a seal that is configured to protect the one or more components disposed in the second cavity from environmental elements.

18 Claims, 17 Drawing Sheets

SURFACE MOUNT LUMINAIRE

RELATED APPLICATIONS

The present application is a continuation application of and claims priority to U.S. patent application Ser. No. 15/958,667 filed Apr. 20, 2018 and titled "Surface Mount Luminaire," the entire contents of which are incorporated herein by reference.

TECHNICAL FIELD

The present disclosure relates generally to lighting solutions, and more particularly to a surface mount luminaire.

BACKGROUND

Surface mount luminaires include light fixtures that are installed on mounting surfaces, such as, a ceiling, a wall, etc. Typically, the surface mount luminaires include enclosures that are disposed behind the mounting surface to house one or more electrical components associated with the surface mount light fixtures. Conventional enclosures include expensive recessed cans in which both the electrical components and the surface mount light fixture are recess mounted. Other conventional enclosures include junction boxes (herein 'j-boxes') that are configured to house the electrical components associated with the surface mount light fixtures. The j-boxes provide an alternative to the expensive recessed cans. However, the j-boxes are progressively getting smaller in size. Finding mounting space for the electrical components is becoming more and more problematic with the reduction in the size of the enclosures and an increase in the quantity of electronics that are packed into surface mount light fixtures. Further, the enclosures that house the electrical components are to be protected from environmental factors, such as moisture, water, etc., to prevent any damage to and/or to prolong an operational life of the surface mount luminaire.

This background information is provided to reveal information believed to be of possible relevance to the present disclosure. No admission is necessarily intended, nor should be construed, that any of the preceding information constitutes prior art against the present disclosure.

SUMMARY

In one aspect, the present disclosure is directed to a light fixture that includes a housing assembly. The housing assembly includes a light source housing having a first surface that defines an inner cavity that is open towards a first direction and a second surface that defines an outer cavity that is open towards a second direction. The first direction is opposite to the second direction, and the first surface is opposite to the second surface. The housing assembly further includes a housing cover that is disposed on and removably coupled to the light source housing such that the housing cover encloses the outer cavity. Further, the luminaire includes a lighting assembly comprising a light source member and an optical lens, the lighting assembly being coupled to the light source housing and disposed in the inner cavity of the light source housing such that light emitted by the light source member exits the light fixture in the first direction. Furthermore, the luminaire includes one or more electrical components associated with the light fixture, the one or more electrical components being mounted on the housing cover and disposed in the outer cavity of the light source housing that is enclosed by the housing cover. The luminaire further includes one or more gaskets that are coupled to the housing assembly to provide a seal that is configured to protect the one or more components disposed in the outer cavity of the light source housing from environmental elements.

In another aspect, the present disclosure is directed to a luminaire that includes a light fixture. The light fixture includes a housing assembly that defines a first cavity that is enclosed and configured to house one or more electrical components associated with the light fixture such that the one or more electrical components are inset within the housing assembly of the light fixture. Further, the light fixture includes one or more gaskets that are coupled to the housing assembly to provide a seal that is configured to protect the one or more components disposed in the enclosed first cavity of the light source housing from environmental elements. The luminaire includes a mounting bracket that is configured to mount the light fixture to a mounting surface.

These and other aspects, objects, features, and embodiments, will be apparent from the following description and the appended claims.

BRIEF DESCRIPTION OF THE FIGURES

The foregoing and other features and aspects of the present disclosure are best understood with reference to the following description of certain example embodiments, when read in conjunction with the accompanying drawings, wherein.

Figure 1:
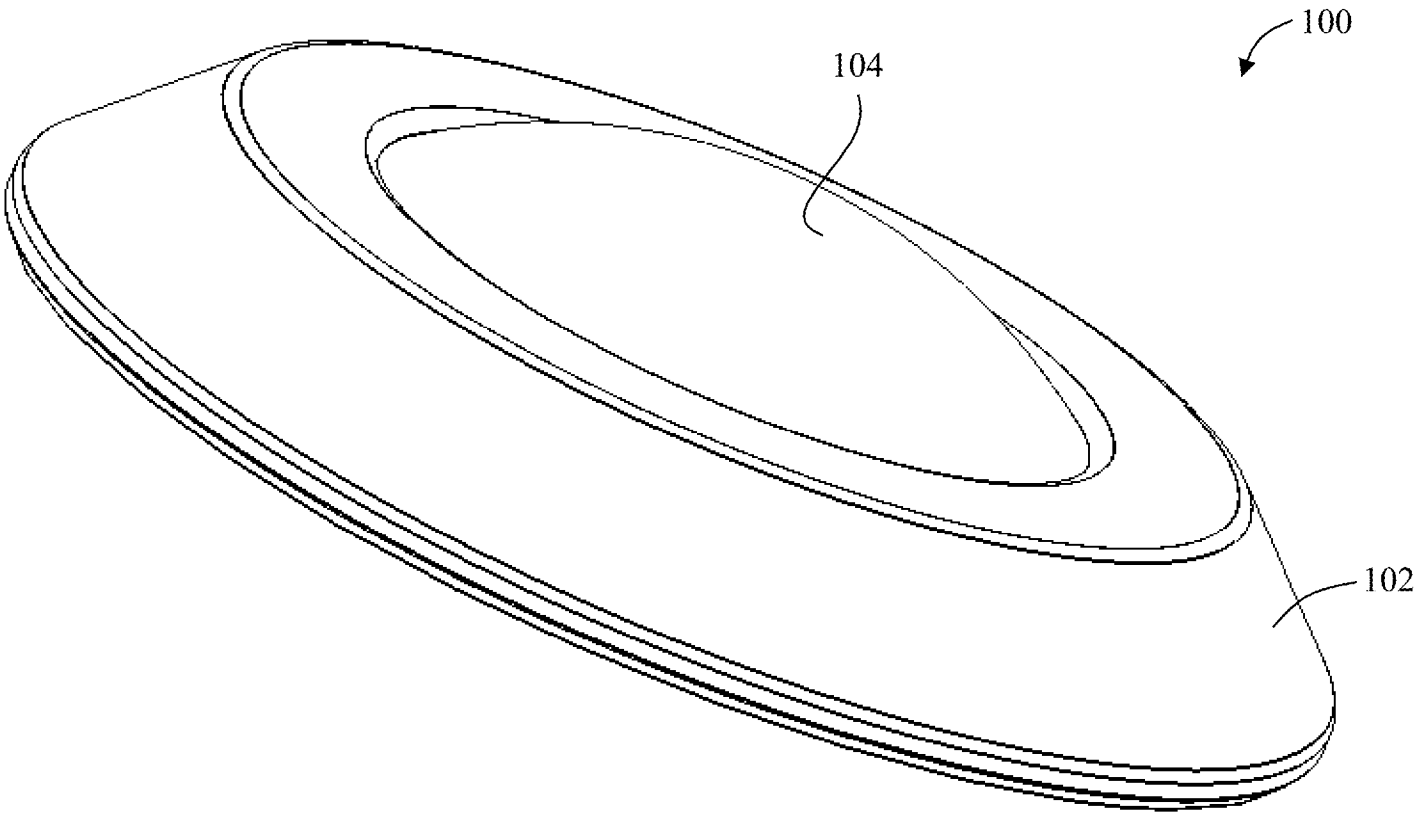
FIG. 1 illustrates a perspective view of an example surface mount luminaire with inset electrical components, in accordance with example embodiments of the present disclosure.

The drawings illustrate only example embodiments of the present disclosure and are therefore not to be considered limiting of its scope, as the present disclosure may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles.

In the foregoing figures showing example embodiments of the example surface mounted luminaire, one or more of the components shown may be omitted, repeated, and/or substituted. Accordingly, the example embodiments of the surface mounted luminaire should not be considered limited to the specific arrangements of components shown in any of the figures. For example, features shown in one or more figures or described with respect to one embodiment can be applied to another embodiment associated with a different figure or description.

DETAILED DESCRIPTION OF EXAMPLE EMBODIMENTS

The present disclosure describes a surface mount luminaire (herein 'luminaire') where the electrical components (e.g., driver and other appropriate components) associated with the luminaire are mounted or inset within a housing of the luminaire in such a way that enables a low profile installation of the luminaire without taking up space in a j-box for housing the electrical components associated with the luminaire. Further, the luminaire includes gaskets that are disposed therein to provide both vertical and horizontal sealing planes within the luminaire for preventing moisture, water, etc., from reaching the electrical components that are inset or disposed within the housing of the luminaire.

Example embodiments of the luminaire will be described more fully hereinafter with reference to the accompanying drawings that describe representative embodiments of the present technology. If a component of a figure is described but not expressly shown or labeled in that figure, the label used for a corresponding component in another figure can be inferred to that component. Conversely, if a component in a figure is labeled but not described, the description for such component can be substantially the same as the description for a corresponding component in another figure. Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

The technology of the luminaire may be embodied in many different forms and should not be construed as being limited to the embodiments set forth herein; rather, these embodiments are provided so that this disclosure will be thorough and complete, and will fully convey the scope of the technology to those appropriately skilled in the art. Further, in addition to the ceiling surface and wall surface, example embodiments of the luminaire of the present disclosure can be mounted to any appropriate mounting surface. Furthermore, the luminaire of the present disclosure can be used with any appropriate lighting application.

The luminaire (or components thereof) described herein can be made of one or more of a number of suitable materials to allow the luminaire and/or other associated components of the luminaire to meet certain standards (e.g., UL wet rating requirement, etc.), cost requirements, and/or regulations while also maintaining durability in view of the one or more conditions under which the luminaire and/or other associated components of the luminaire can be exposed. Examples of such materials can include, but are not limited to, plastic, aluminum, stainless steel, copper, fiberglass, ceramic, etc.

Further, components of the luminaire (or portions thereof) described herein can be made from a single piece. Even though the present disclosure describes the housing of the luminaire as being a stamped or drawn housing, in other embodiments, the housing can be formed using other manufacturing processes such as from a mold, injection mold, or die cast. In addition, or in the alternative, components of the luminaire (or portions thereof) can be made from multiple pieces that are mechanically coupled to each other. In such a case, the multiple pieces can be mechanically coupled to each other using one or more of a number of coupling methods, including but not limited to adhesives, welding, soldering, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably.

Terms such as "first", "second", "third", "top", "bottom", "side", and "within" are used merely to distinguish one component (or part of a component or state of a component) from another. Such terms are not meant to denote a preference or a particular orientation, and are not meant to limit embodiments of the luminaire. In the following detailed description of the example embodiments, numerous specific details are set forth in order to provide a more thorough understanding of the present disclosure. However, it will be apparent to one of ordinary skill in the art that the luminaire of the present disclosure may be practiced without these specific details. In other instances, well-known features have not been described in detail to avoid unnecessarily complicating the description.

Turning now to the figures, example embodiments of a mounting system will be described in connection with FIGS. 1-17. Referring to FIGS. 1-17, an example luminaire may include a light fixture 100 and a mounting bracket 206 that is used to mount the light fixture 100 to a mounting surface 1701 (shown in FIG. 17). The light fixture 100 may include a housing assembly that is defined by a light source housing 102 and a housing cover 202 (shown in FIG. 2) that is removably coupled to the light source housing 102. The housing assembly may be configured to house a lighting assembly 103 associated with the light fixture 100 and electrical components 1702 (shown in FIG. 17) associated with lighting assembly 103 therein. In particular, the electrical components 1702 may be inset within the housing assembly as will be described below in further detail. Additionally, the light fixture 100 may include one or more gaskets that are coupled to and positioned in the housing assembly to create a seal for: (a) preventing environmental elements such as water, moisture, etc., from reaching the electrical components housed in the housing assembly of the light fixture 100, and/or (b) meeting a UL (Underwriters Laboratories) wet rating requirement.

Light Fixture

Figure 6:
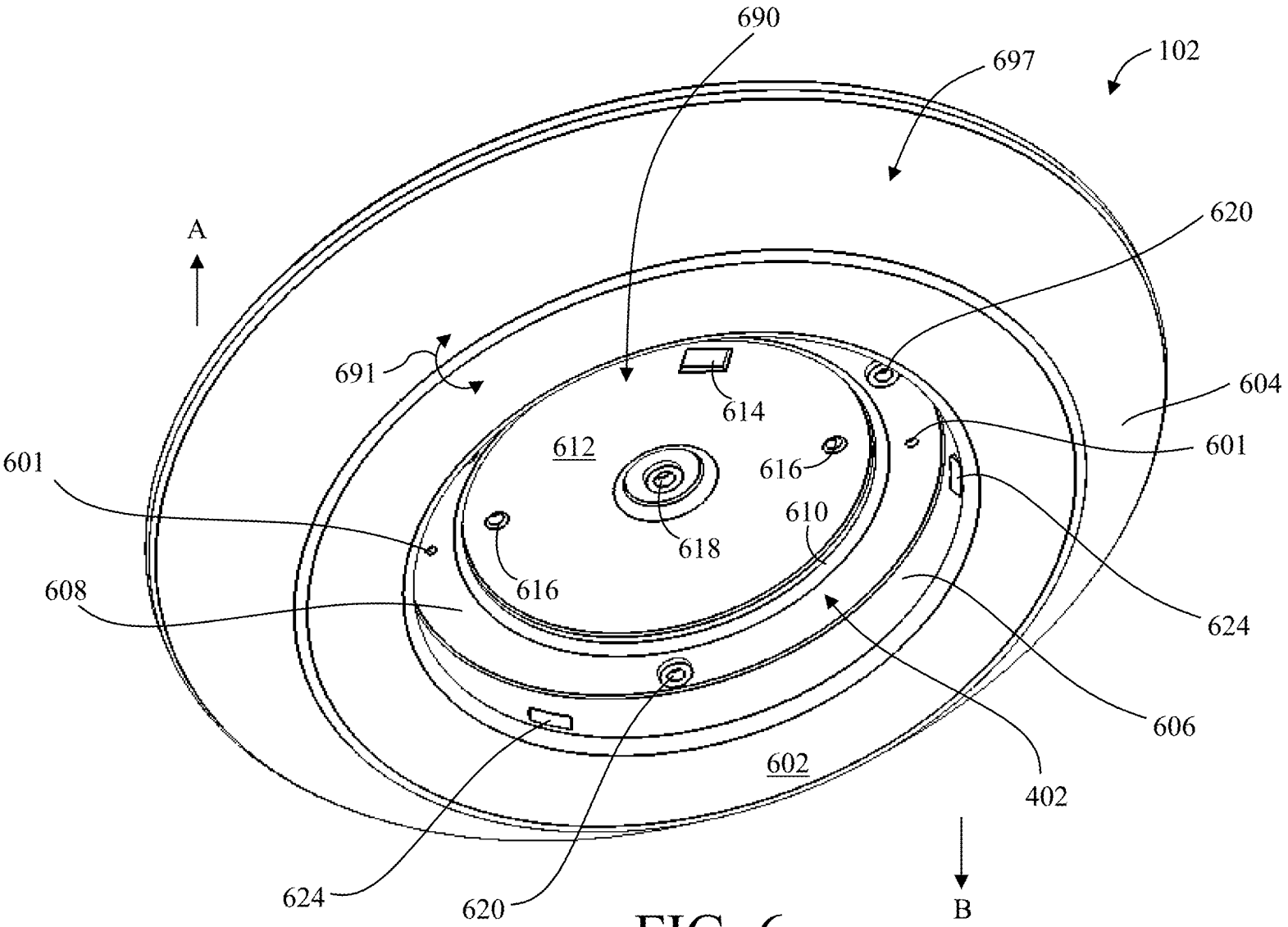
FIG. 6 illustrates a perspective view of a light source housing of the example surface mount luminaire of FIG. 1, in accordance with example embodiments of the present disclosure.
Figure 7:
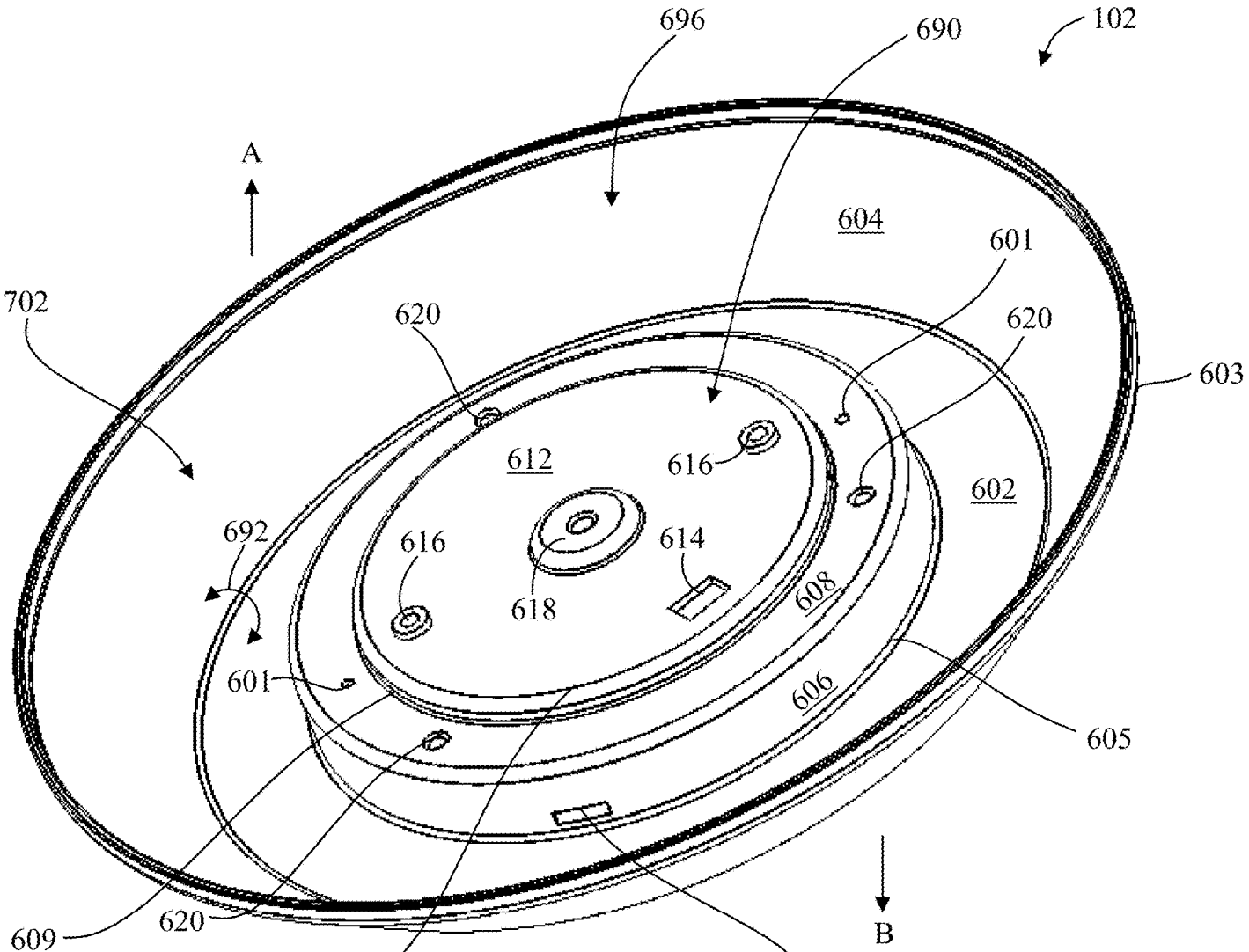
FIG. 7 illustrates another perspective view of the light source housing of the example surface mount luminaire of FIG. 1, in accordance with example embodiments of the present disclosure.

In particular, as illustrated in FIGS. 6 and 7, the light source housing 102 of the light fixture 100 may include a top wall 612 that is substantially disc shaped. The top wall 612 may include a first set of coupling apertures 616, a wire routing opening 614, and a central opening 618 that are formed therein. Further, the light source housing 102 may include a first sidewall 610 that extends in a first direction (e.g., direction B) substantially perpendicular to the top wall 612 from a perimeter of the top wall 612 to a first bottom edge 609. Furthermore, the light source housing 102 may include a first flange 608 that extends substantially horizontally and radially outward from the first bottom edge 609 of the first sidewall 610 such that the first flange 608 is substantially perpendicular to the first sidewall 610 and substantially parallel to the top wall 612. The first flange 608 may include a second set of coupling apertures 620 and a pair of locator openings 601. Additionally, the light source housing 102 may include a second sidewall 606 that extends in the first direction (e.g., direction B) and substantially perpendicular to the first flange 608 and the top wall 612 from an outer perimeter of the first flange 608 to a second bottom edge 605.

In one example embodiment, the top wall 612, the first sidewall 610, the first flange 608, and the second sidewall 606 may be concentrically arranged to form a recessed structure 690 that defines an inner cavity 402 that is open towards and faces the first direction (e.g., direction B). The second sidewall 606 may include a plurality of retention tabs 624 that are formed therein and equally spaced apart from each other. Each retention tab 624 may be bent inwards from the second sidewall 606 towards the inner cavity 402. Each of the plurality of retention tabs 624 are integral with the second sidewall 606 and may be formed by cutting a portion of the second sidewall 606 and pushing/bending it out towards the inner cavity 402. In other example embodiments, the plurality of retention tabs 624 may be coupled to the second sidewall 606.

In addition to the recessed structure 690, the light source housing 102 may include a second flange 602 that extends substantially horizontally and radially outward from the second bottom edge 605 of the second sidewall 606 such that the second flange 602 is substantially perpendicular to the first and second sidewalls (610, 606) and is substantially parallel to the top wall 612 and the first flange 608. Furthermore, the light source housing 102 may include a third sidewall 604 that extends in a second direction (e.g., direction A) that is opposite to the first direction (e.g., direction B) from an outer perimeter of the second flange 602. In particular, the third sidewall 604 may extend at an angle from the outer perimeter of the second flange 602 to a top edge 603 such that the third sidewall 604 forms an obtuse inner angle 692 and a reflex outer angle 691 with the second flange 602. The top edge 603 of the third sidewall 604 may be vertically oriented such that it is substantially parallel to the first and second sidewalls (610, 606). The recessed structure 690, the second flange 602, and the third sidewall 604 may define an outer cavity 702 that is open towards and faces the second direction (e.g., direction A). In particular, a first surface 696 (e.g., outer surface) of the recessed structure 690 the second flange 602, and the third sidewall 604 define the outer cavity 702 that is open towards and faces one direction, while the opposite second surface 697 (e.g., inner surface) of the recessed structure 690 define the inner cavity 402 that is open towards and faces an opposite direction. For example, when mounted, the inner cavity 402 faces an area that is to be illuminated while the outer cavity 702 faces the mounting surface (away from the area that is to be illuminated).

As illustrated in FIGS. 6 and 7, the second sidewall 606 may be taller than the first sidewall 610, with the height of a sidewall being measured from the outer perimeter of the wall or flange (612, 608) to the respective sidewall's bottom edge (609, 605). Further, the height of the third sidewall 604 that is measured from the top edge 603 of the third sidewall 604 to the outer perimeter of the second flange 602 may be greater than a height of the recessed structure 690 that is measured as a vertical distance between the top wall 612 and a plane comprising the second flange 602. In other words, the third sidewall 604 may extend beyond and traverse a plane comprising the top wall 612 of the recessed structure 690. Furthermore, a diameter across the outer edge/perimeter of the second flange 602 may be larger than a diameter across the outer edge/perimeter of the first flange 608 which in turn may be larger than a diameter of the top wall 612.

Even though the present disclosure describes the light source housing 102 as having a specific shape and dimension, one of skill in the art can understand and appreciate that in other example embodiments, the light source housing 102 can have any other appropriate geometric or non-geometric shape, and the dimensions of the light source housing 102 may vary without departing from a broader scope of the present disclosure. For example, in some example embodiments, the height of the first and second sidewall (610 and 606) may be the same, or the height of the third sidewall 604 and the height of the recessed structure 690 may be substantially similar. In another example, the depth of the outer cavity 702 and/or inner cavity 402 may vary based on the quantity and the size of the electrical components 1702 and/or the lighting assembly 103 that is housed within the outer cavity 702 and inner cavity 402, respectively. Furthermore, in other example embodiments, the inner cavity 402 and the outer cavity 702 may have any other appropriate geometric or non-geometric shape without departing from a broader scope of the present disclosure.

Alternatively, the light source housing 102 may be described as including a substantially annular base wall 602 defined by an inner edge 605 and an outer edge 699. Further, the light source housing 102 may include a recessed structure 690 that extends vertically upwards in a second direction (direction A) from the inner edge 605 such that the recessed structure 690 defines an inner cavity 402 that faces and is open towards the first direction (direction B) that is opposite to the second direction (direction A). Furthermore, the light source housing 102 may include a sidewall 604 that extends upwards at angle in the second direction (direction A) from the outer edge 699 of the base wall 602. It is noted that the first and second directions are not limited to directions B and A, respectively. That is, in other examples, the first direction may be direction A while the second direction may be direction B without departing from a broader scope of the present disclosure.

Figure 3:
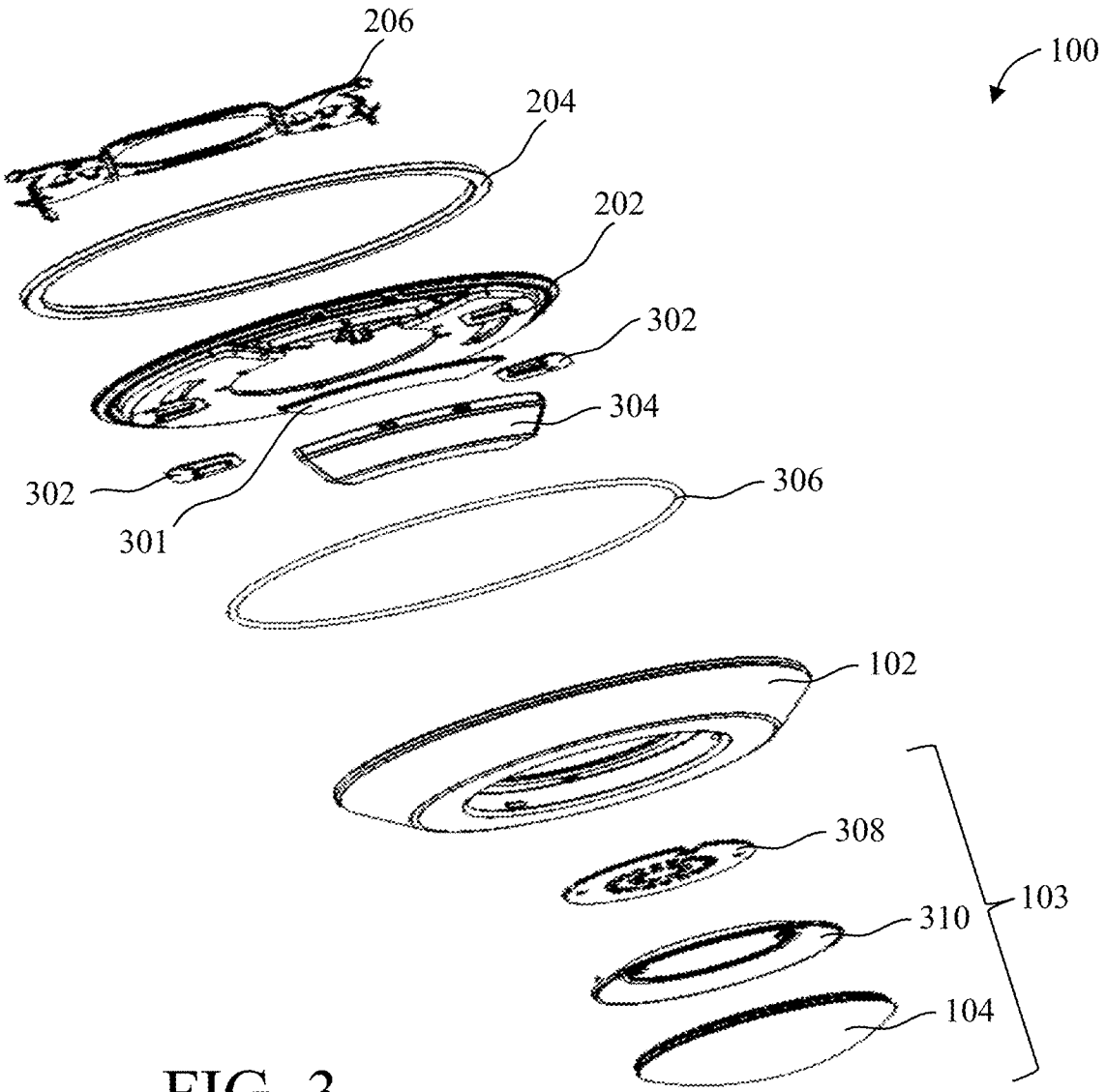
FIG. 3 illustrates an exploded view of the example surface mount luminaire of FIG. 1, in accordance with example embodiments of the present disclosure.
Figure 4:
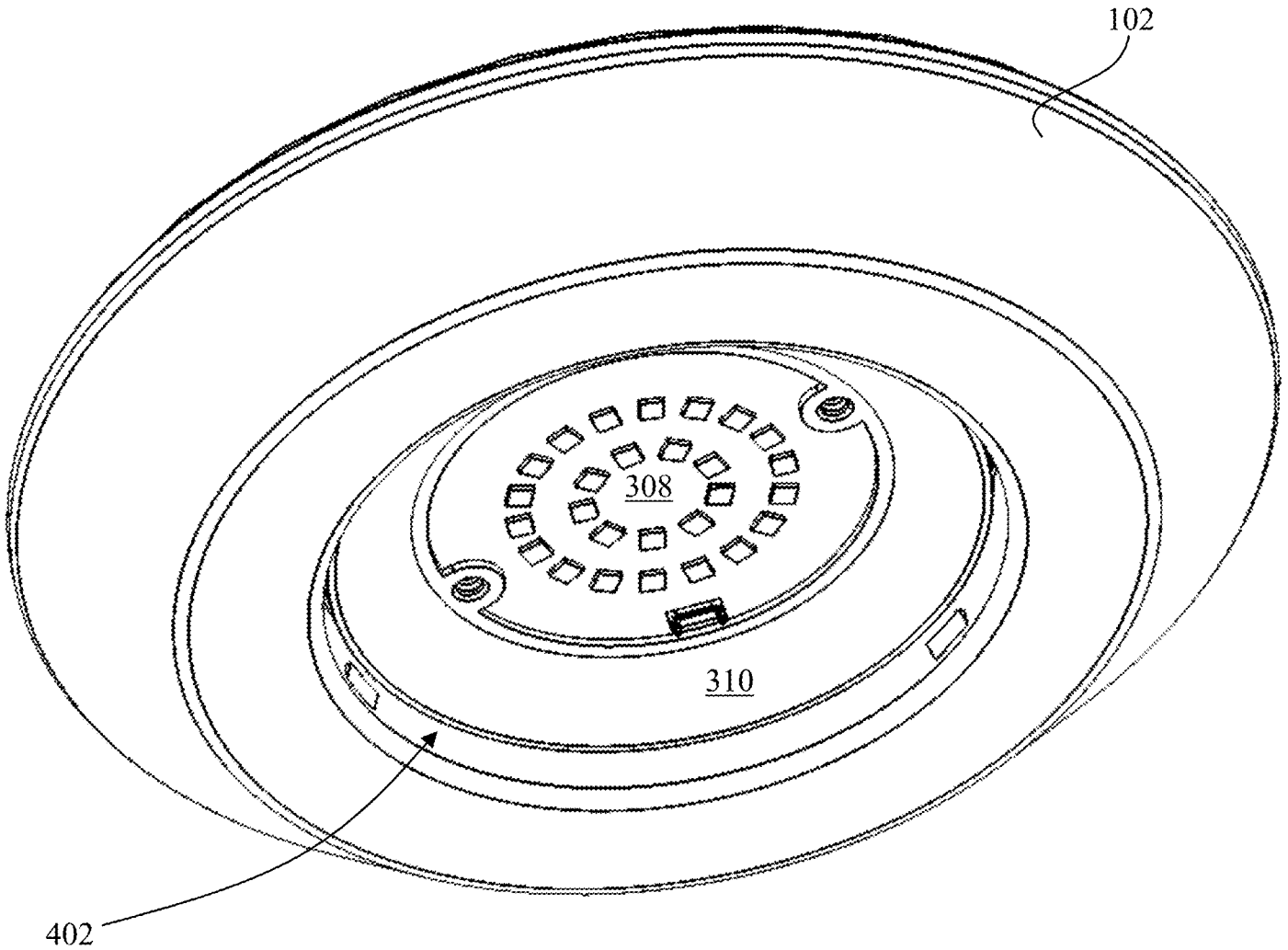
FIG. 4 illustrates a perspective view of the example surface mount luminaire of FIG. 1 with the optical lens having been removed from the luminaire, in accordance with example embodiments of the present disclosure.

As illustrated in FIGS. 1, 3, and 4, the inner cavity 402 that is defined by the inner surface of the recessed structure 690 may be configured to house the lighting assembly 103 (shown in FIG. 3). The lighting assembly 103 may include the light source member 308, the reflector 310, and the optical lens 104. In particular, the lighting assembly 103 may be housed in the inner cavity 402 defined by the inner surface 697 of the recessed structure 690 of the light source housing 102 by: (a) coupling the light source member 308 and the reflector 310 to the top wall 612 of the light source housing 102 using fasteners, and (b) coupling the optical lens 104 to the second sidewall 606 of the light source housing 102 by a snap mechanism using the plurality of retention tabs 624 on the second sidewall 606.

Figure 9:
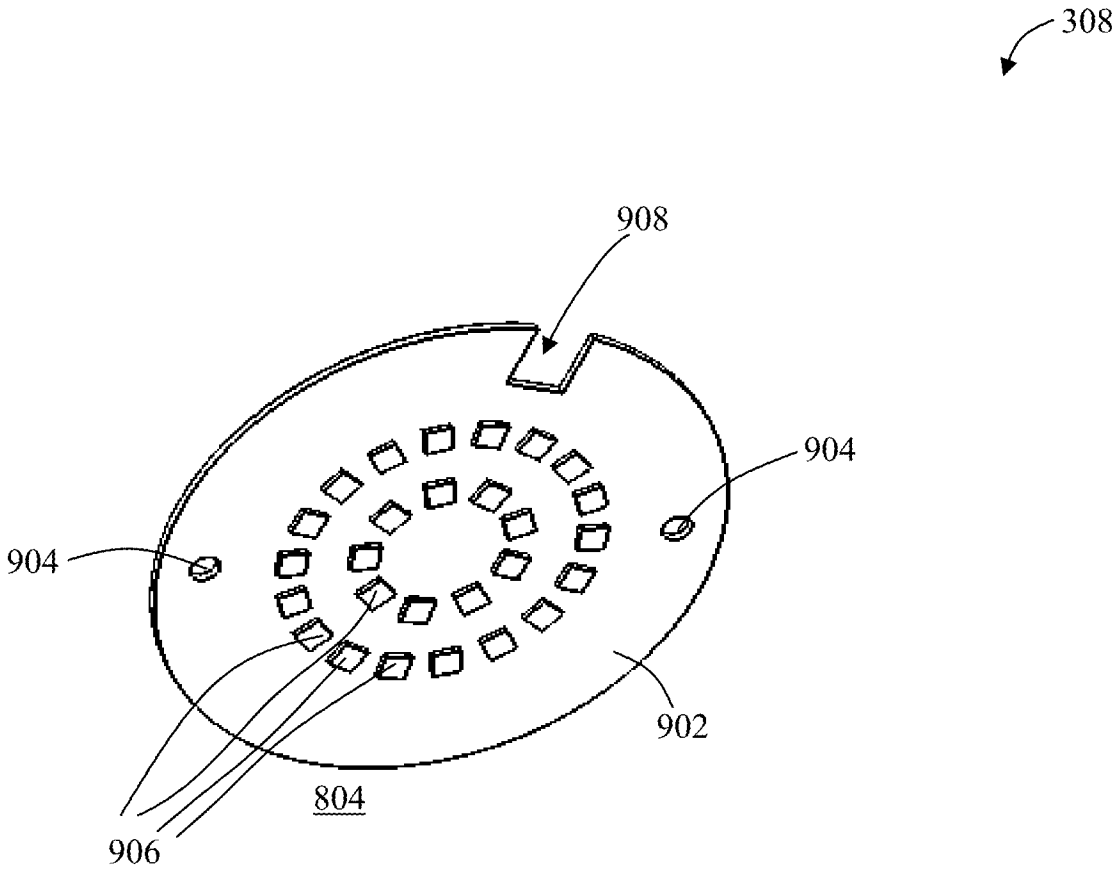
FIG. 9 illustrates a perspective view of a light source member of the example surface mount luminaire of FIG. 1, in accordance with example embodiments of the present disclosure.

As illustrated in FIG. 9, the light source member 308 may include a plurality of light sources 906 that are disposed on a substrate 902, such as a printed circuit board. The plurality of light sources 906 may include point light sources, such as light emitting diodes (LEDs) or any other appropriate light sources. The substrate 902 may include a notch 908 that is formed at a portion of the perimeter of the substrate 902. The notch 908 may be cut into the substrate 902 to route electrical wires from the electrical components 1702 (e.g., driver) to the substrate 902 and/or the light sources 906 for supplying operational power to the light sources 906. Further, the substrate 902 may include coupling apertures 904 that are formed therein to receive fasteners therethrough for coupling the light source member 308 to the top wall 612 of the light source housing 102.

Figure 8:
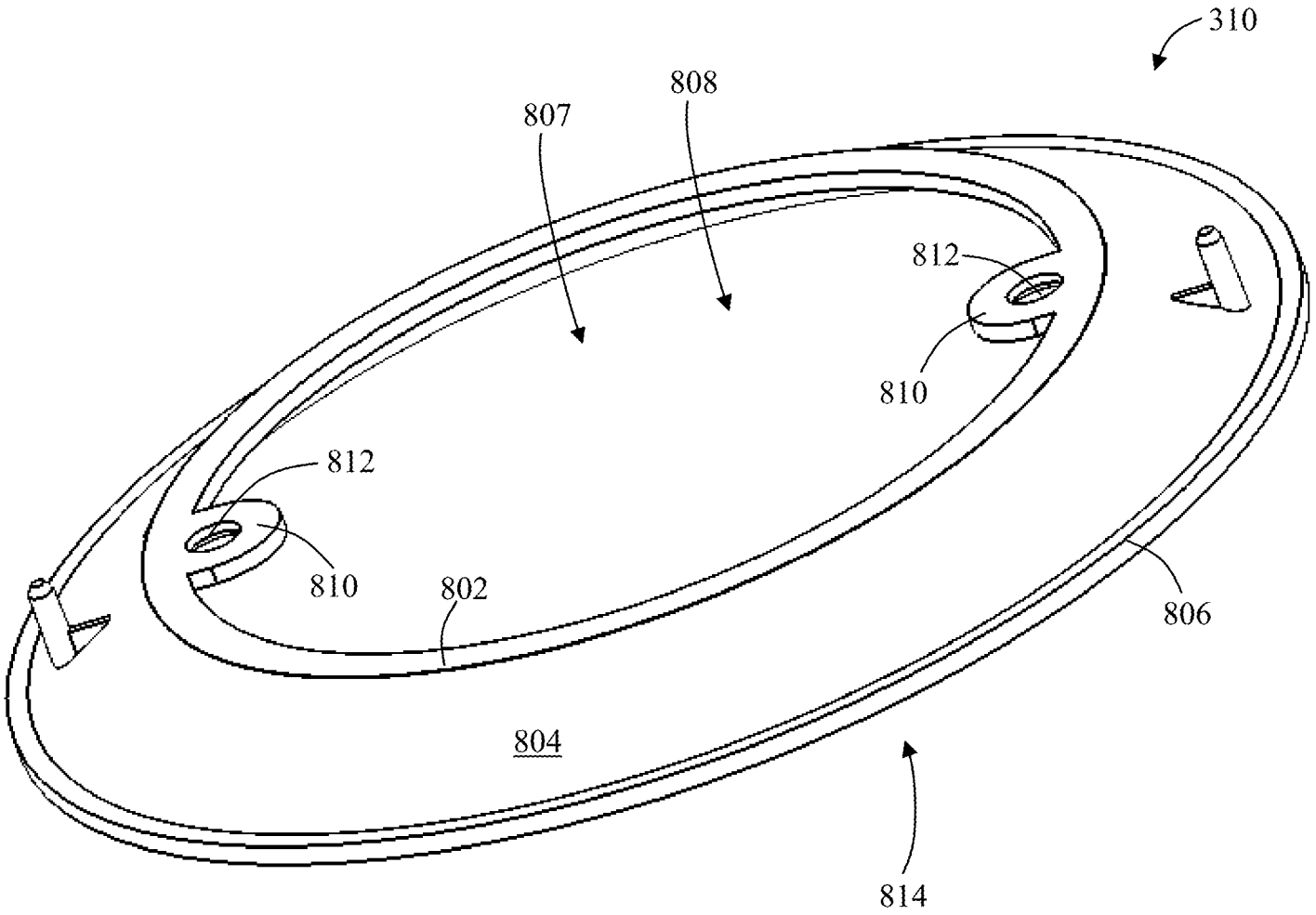
FIG. 8 illustrates a perspective view of a reflector member of the example surface mount luminaire of FIG. 1, in accordance with example embodiments of the present disclosure.

Turning to FIG. 8, the reflector 310 may include a top annular edge 802 that defines a light receiving opening 808 and a body 804 that extends or flares out from the top edge 802 to a bottom annular edge 806 that defines a light emitting opening 814. The body 804 of the reflector 804 may define a light channeling cavity 807 which is a through cavity that extends from the light receiving opening 808 through the light emitting opening 814. Further, the reflector 310 may include coupling tabs 810 that are substantially semi-circular in shape and project into the light receiving opening 808 from an inner perimeter of the top annular edge 802. Each of the coupling tabs 810 may include a coupling through hole 812 that extends therethrough for coupling the reflector 310 to the top wall 612 of the light source housing 102. The reflector 310 may be formed using a reflective material or may be coated with reflective material to reflect and guide light towards an area that is to be illuminated.

As illustrated in FIG. 4, the light source member 308 and the reflector 310 may be coupled to and secured within the inner cavity 402 of the light source housing 102 by: (a) positioning the light source member 308 on the top wall 612 such that the plurality of light sources 906 face the first direction (e.g., direction B), i.e., away from the top wall 612 and the coupling apertures 904 of the light source member 308 are axially aligned with the coupling apertures 616 on the top wall 612 of the light source housing 102; (b) positioning the reflector 310 on the light source member 308 in the inner cavity 402 such that the light receiving opening 808 of the reflector 310 receives the plurality of light sources 906 therethrough and the coupling through holes 812 formed in the coupling tabs 810 of the reflector 310 are axially aligned with the coupling apertures 904 of the light source member 308 and the coupling apertures 616 on the top wall 612 of the light source housing 102; and (c) passing fasteners through the axially aligned coupling through holes 812 of the reflector 310, the coupling apertures 904 of the light source member 308, and the coupling apertures 616 on the top wall 612 of the light source housing 102. In other words, the light source member 308 and the reflector 310 are coupled to the top wall 612 of the light source housing 102 such that the light source member 308 is disposed between the top edge 802 of the reflector 310 and the top wall 612 of the light source housing 102. The reflector 310 is configured to hold the light source member 308 in place and also to direct/guide light towards an area to be illuminated.

Figure 5:
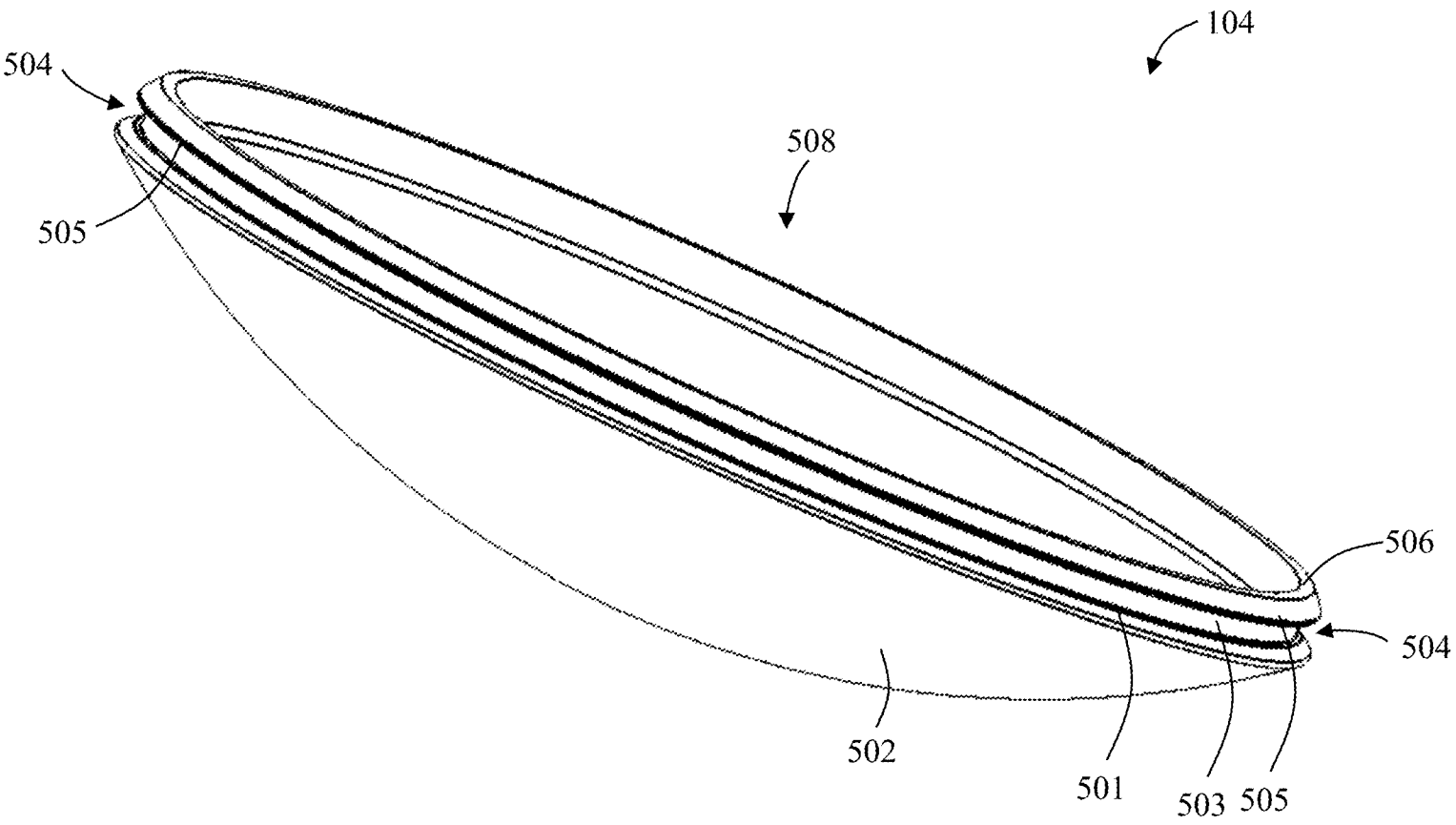
FIG. 5 illustrates a perspective view of the optical lens of the example surface mount luminaire of FIG. 1, in accordance with example embodiments of the present disclosure.

Turning to FIG. 5, the optical lens 104 of the lighting assembly 103 may include a dome shaped portion 502 that is defined by a convex outer surface and a concave inner surface. Further, the optical lens 104 may include a collar 503 that extends vertically from a top edge 501 of the dome shaped portion 502 and a coupling flange 506 that extends radially outward from an outer edge 505 of the collar 503. The coupling flange 506 defines an opening 508 through which light emitted by the plurality of light sources 906 enter the optical lens 104. The coupling flange 506, the collar 503, and the top edge 501 of the dome shaped portion 502 form a groove 504 that is disposed between the coupling flange 506 and the top edge 501 of the dome shaped portion 502 of the optical lens 104. The optical lens 104 may be coupled to the light source housing 102 by inserting the optical lens 104 in the inner cavity 402 of the light source housing 102 such that: (a) the coupling flange 506 of the optical lens 104 engages the plurality of retention tabs 624 on the second sidewall 606 of the light source housing 102, and (b) the convex surface of the optical lens 104 projects out from the inner cavity 402 and past a plane comprising the second flange 602 of the light source housing 102. In other words, the optical lens 104 snaps into the inner cavity 402 of the light source housing 102.

The optical lens 104 may be configured to conceal the inner cavity 402 of the light source housing 102 along with the reflector 310 and the lighting source member 308 that is housed in the inner cavity 402. The light emitted by the plurality of light sources 906 may pass through the light channeling cavity 807 of the reflector 310, the opening 508 of the optical lens 104, and the dome shaped portion 502 of the optical lens 104 to exit the light fixture 100 into an area that is to be illuminated (e.g., a room in direction B). In some example embodiments, the optical lens 104 may be a diffuser lens. The material and thickness of the optical lens 104 may vary based on a power rating of the light source member 308 comprising the light sources 906. For example, the material and thickness of the optical lens 104 used in the light fixture 100 when the lighting fixture 100 includes a 60V LED board (which is considered as a high voltage LED board under UL ratings) may be different than when the lighting fixture includes a low voltage LED board.

Figure 10:
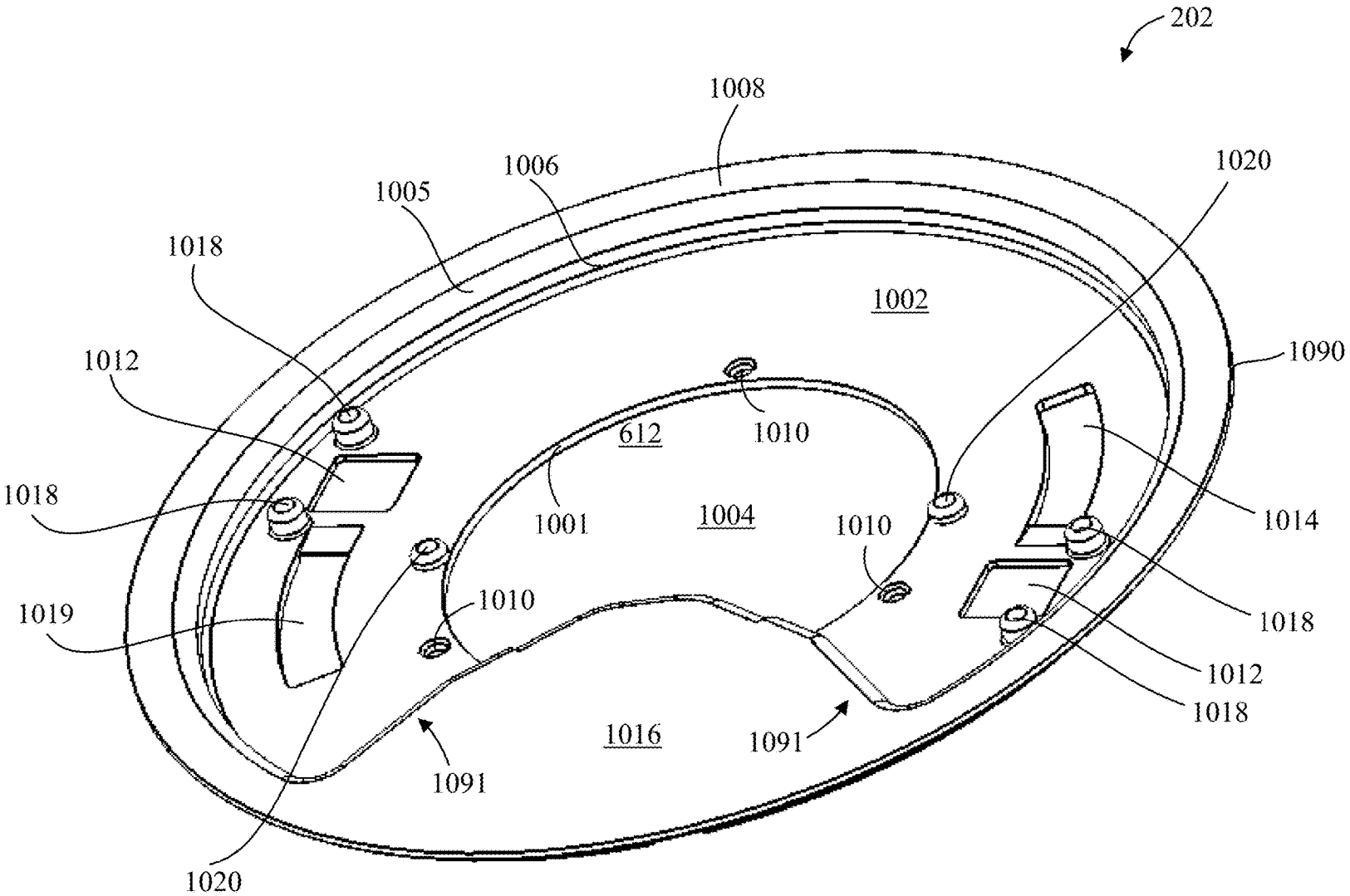
FIG. 10 illustrates a perspective view of a first side of a housing cover of the example surface mount luminaire of FIG. 1, in accordance with example embodiments of the present disclosure.
Figure 11:
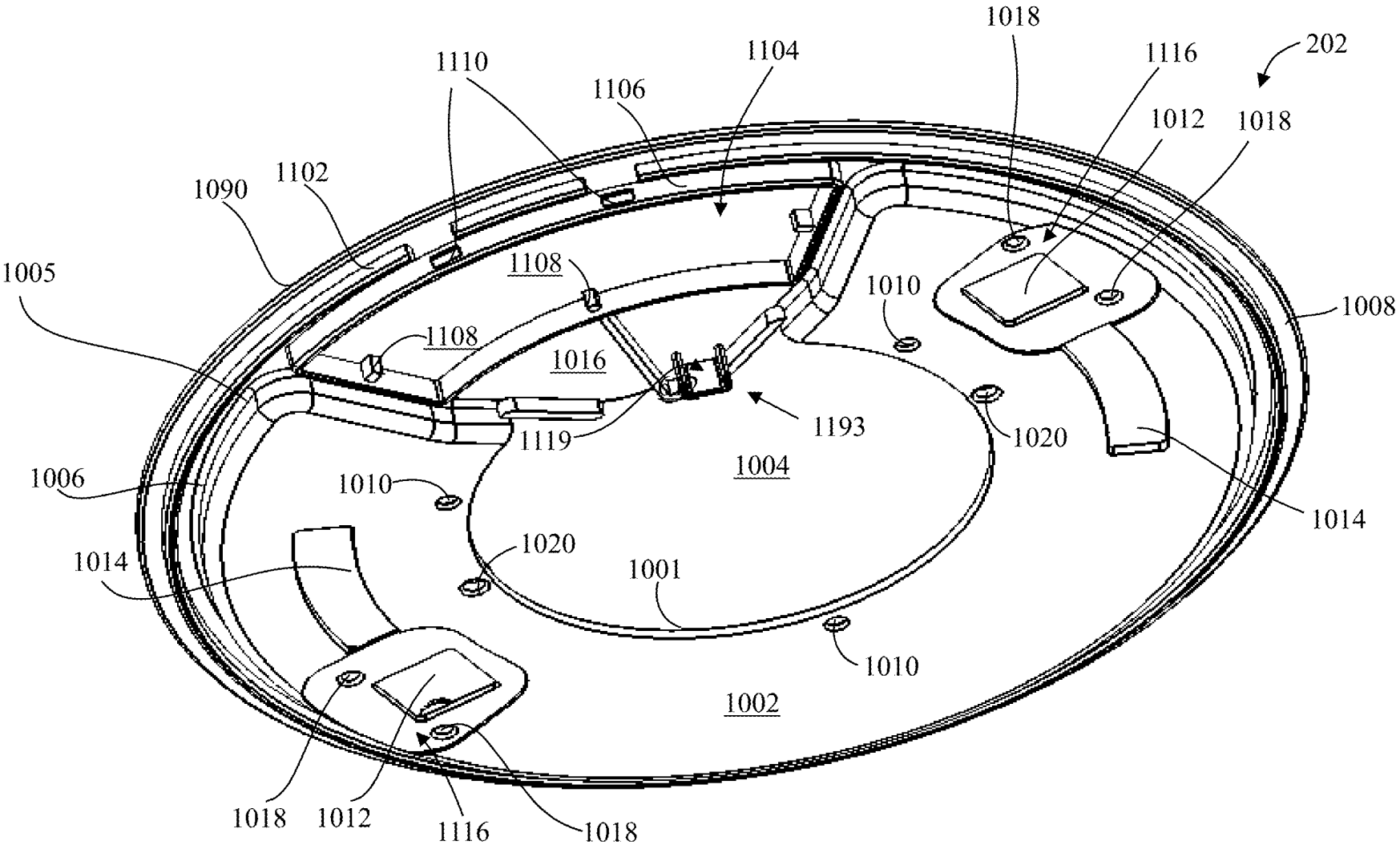
FIG. 11 illustrates a perspective view of an opposite second side of the housing cover of the example surface mount luminaire of FIG. 1, in accordance with example embodiments of the present disclosure.

As illustrated in FIGS. 10 and 11, in addition to the light source housing 102 and the lighting assembly 103 that is disposed in the inner cavity 402 of the light source housing 102, the light fixture 100 may include a housing cover 202 that may be coupled to the light source housing 102 such that the housing cover 202 encloses the outer cavity 702 defined by the light source housing 102. The enclosed outer cavity 702 may be configured to house one or more of the electrical components 1702 associated with the light fixture 100. The housing cover 202 may include one or more features that are configured to mount and securely hold the electrical components 1702 within the outer cavity 702 of the light source housing 102.

In particular, the housing cover 202 may include a base 1002 that is defined by a substantially horseshoe shaped body that extends between an outer curved edge 1006, an inner curved edge 1001, and linear edges 1091 disposed between the ends of the outer and inner curved edges (1006, 1001). The inner curved edge 1001 defines a central aperture 1004 that is larger than the diameter of the top wall 612 of the light source housing 102. Further, the housing cover 202 may include a sidewall 1005 that extends substantially perpendicular to the base 1002 from the outer edge 1006 and the linear edges 1091 of the base 1002. Furthermore, the housing cover 202 may include a top flange 1008 that extends substantially perpendicular to the sidewall 1005 and substantially parallel to the base 1002. A portion of the top flange 1008 extends radially outward from the top edge of a portion of the sidewall; while a remainder portion of the top flange 1008 extends inward towards and partially into the central aperture 1004 from a remainder portion of the top edge of the sidewall 1005. In other words, between the linear edges 1091 of the base 1002, the top flange widens and extends inward partially into the central aperture 1004.

The portion of the top flange 1008 that extends inward and partially into the central aperture 1004 may define an elevated segment 1016 (interchangeably referred to as 'component mounting segment 1016'). In the example embodiment illustrated in FIGS. 10 and 11, the elevated segment 1016 may be shaped substantially like a sector of a circle with a rounded tip 1193. However, in other embodiments, the shape and size of the elevated segment may vary to include any appropriate size and shape without departing from a broader scope of the present disclosure.

A first surface of the elevated segment 1016, i.e., the surface of the elevated segment 1016 facing the base 1002 may include a component housing wall 1106 that extends substantially perpendicular to the portion of the top flange 1008 that defines the elevated segment 1016. The component housing wall 1106 may be shaped substantially like an annulus sector and may be disposed between the linear edges 1091 of the base 1002. As illustrated in FIG. 11, the component housing wall 1106 may further include a first set of bosses 1108 that project inwards from an inner surface of the component housing wall 1106. Further, the outer surface of the component housing wall 1106 may include snap tabs 1110 that project outwards at an angle from the outer surface of the component housing wall 1106. The snap tabs 1110 may be configured to secure a component cover 304 to the housing cover 202 as will be described below in greater detail.

Figure 12:
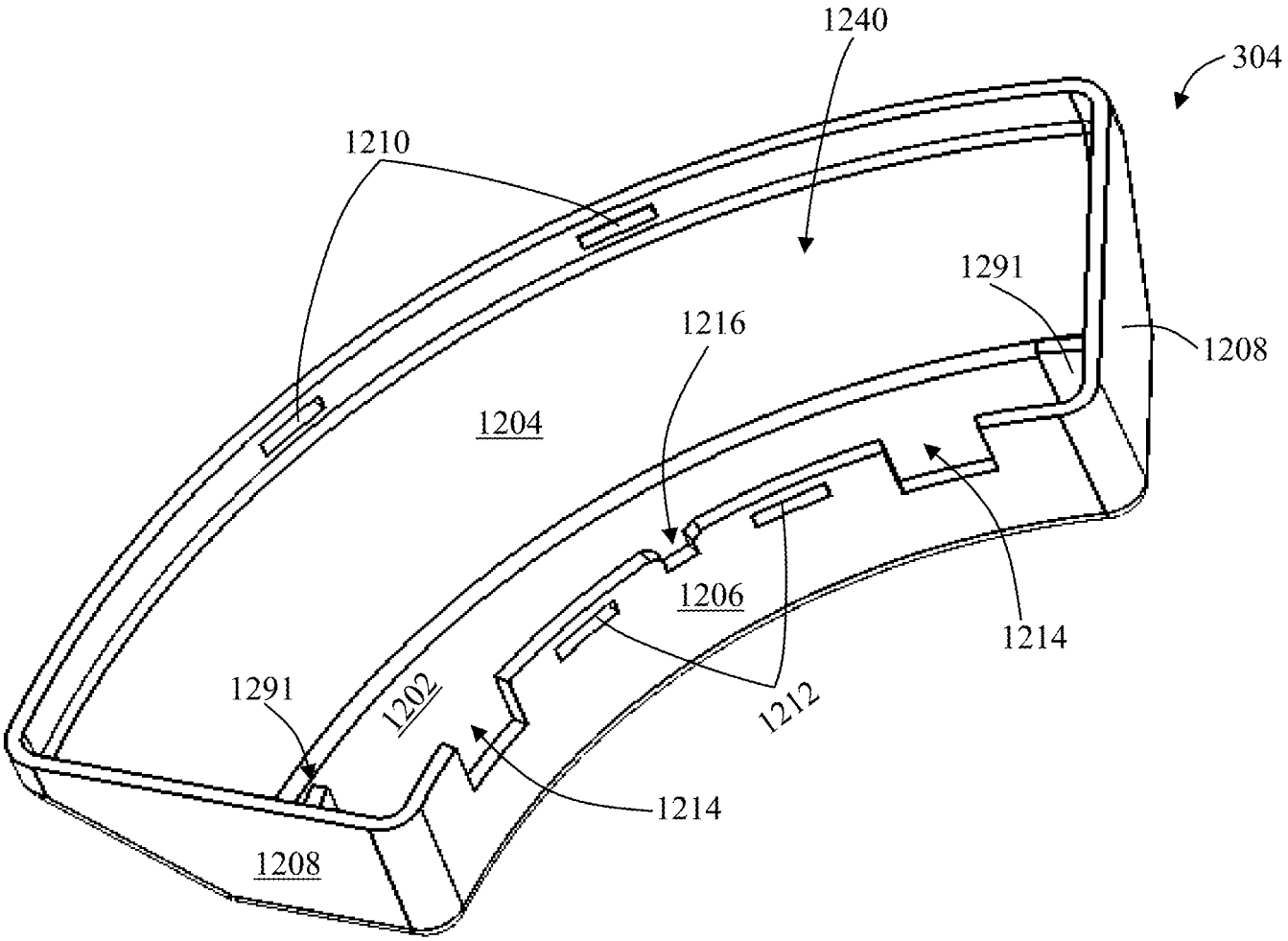
FIG. 12 illustrates a perspective view of an electrical component cover of the example surface mount luminaire of FIG. 1, in accordance with example embodiments of the present disclosure.

Turning to FIG. 12, the component cover 304 may include a bottom wall 1202 that is defined by two curved long edges and two linear short edges disposed between the opposite ends of the two curved long edges. Further, the component cover 304 may include a sidewall 1203 that extends substantially perpendicular to the base 1202 from a perimeter of the base 1202. The sidewall 1203 and the base 1202 may define a substantially annulus sector shaped component cavity 1240 that is open at a top edge of the sidewall 1203. A portion of the sidewall 1204 that extends from an outer curved long edge of the bottom wall 1202 may include a first set of snap slots 1210 formed adjacent the top edge of the portion of the sidewall 1204. Further, a portion of the sidewall 1204 that extends from an opposite inner curved long edge of the bottom wall 1202 may include wire routing notches 1214 and a central bridge notch 1216 formed at the top edge of the portion of the sidewall 1204. Furthermore, the portion of the sidewall 1204 that extends from the opposite inner curved long edge of the bottom wall 1202 may include a second set of snap slots 1212. Additionally, the component cover 304 may include a second set of bosses 1291 that extend into the component cavity 1240 from the base 1202 towards the top edge of the sidewall 1203 along an inner surface of the sidewall 1203.

Figure 15:
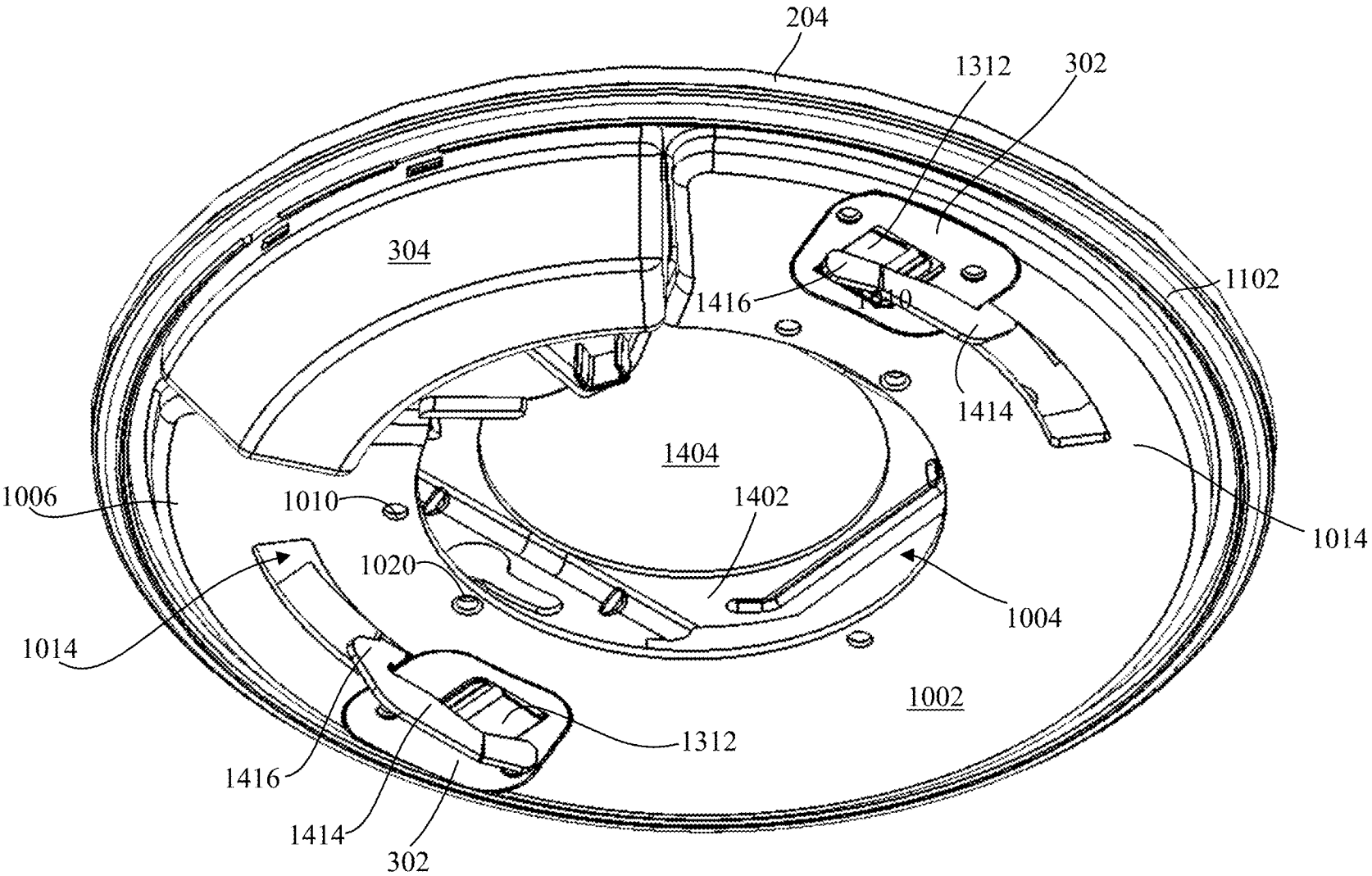
FIG. 15 illustrates a perspective view of the example surface mount luminaire of FIG. 1 with the light source housing, light source member, the reflector, and the optical lens having been removed, in accordance with example embodiments of the present disclosure.

As illustrated in FIG. 15, the component cover 304 may be coupled to the housing cover 202 by snapping the component cover 304 to the component housing wall 1106. In particular, the snap tabs 1110 on the outer surface of the component housing wall 1106 snap into the first and second set of snap slots (1210, 1212) of the component cover 304 to couple and securely retain the component cover 304 against the housing cover 202. The component cover 304 may be coupled to the housing cover 202 such that the component cavity 1240 is enclosed by the portion of the top flange 1008 that defines the elevated segment 1016 of the housing cover 202. Even though the present disclosure describes coupling the component cover 304 to the housing cover 202 using a snap mechanism, one of skill in the art can understand and appreciate that in other example embodiments, any other appropriate coupling techniques may be used without departing from a broader scope of the present disclosure. Further, in other example embodiments, the component cover 304 and the component housing wall 1106 may have any other appropriate shape without departing from a broader scope of the present disclosure. The shape and size of the component cover 304 may vary depending on the number of electrical components 1702, the driver board, the size of the outer cavity 702 of the light source housing 102, etc., without departing from a broader scope of the present disclosure. Furthermore, in some example embodiments, the housing cover 202 may have more than one elevated segment 1016 without departing from a broader scope of the present disclosure.

Figure 16:
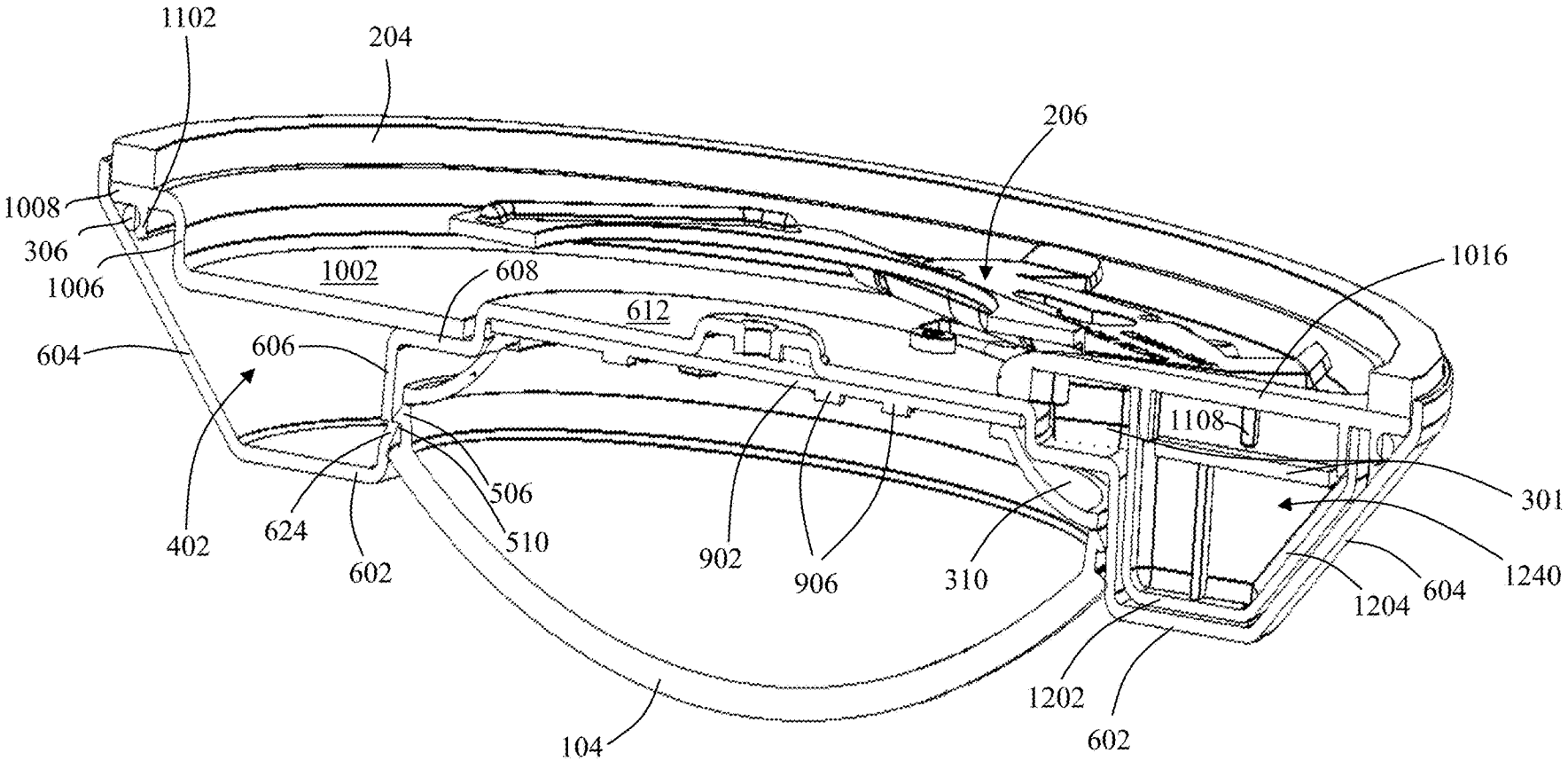
FIG. 16 illustrates a sectional view of the example surface mount luminaire of FIG. 1, in accordance with example embodiments of the present disclosure.
Figure 17:
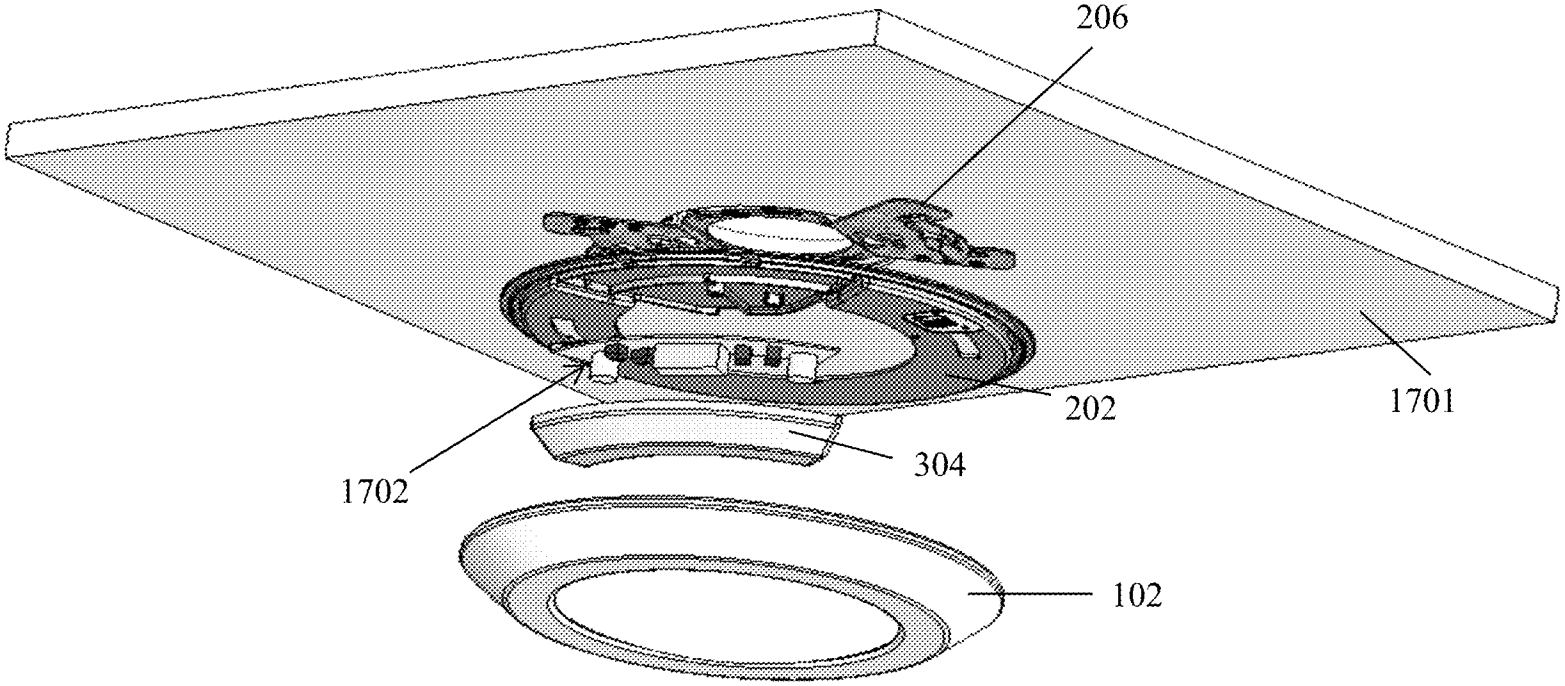
FIG. 17 illustrates a perspective view of the example surface mounted luminaire being mounted to a mounting surface, in accordance with example embodiments of the present disclosure.

As illustrated in FIGS. 16-17, a driver board 301 may be disposed within the enclosed component cavity 1240. The driver board 301 may be positioned in a space between the first and second set of bosses (1108, 1291) of the component housing wall 1106 and the component cover 304; and the electrical components 1702 may be disposed on the driver board 301 such that they extend towards the base 1202 of the component cover 304.

Turning back to FIGS. 10 and 11, the elevated segment 1016 of the housing cover 202 may include a wire routing wall 1119 that is disposed adjacent the rounded tip portion 1193 of the elevated segment 1016 that extends into the central aperture 1004. Wires from the electrical components 1702 disposed in the enclosed component cavity 1240 may be routed to the light source member 308 disposed in the inner cavity 402 of the light source housing 102 through the wire routing notches 1214 of the component cover 304, the wire routing wall 1119, and wire routing opening 614 on the top wall 612 of the light source housing 102. In particular, the height of the wire routing notches 1214 on the component cover 304 may be larger than the height of the component housing wall 1106 of the housing cover 202. Accordingly, when the component cover 304 is coupled to the component housing wall 1106 of the housing cover 202, a gap may exist between the bottom end of each wire routing notch 1214 and the component housing wall 1106 of the housing cover 202 through which the electrical wires from the electrical components 1702 may exit the enclosed component cavity 1240.

Additionally, the housing cover 202 may include a sealing wall 1102 that is offset from the outer edge 1090 of the top flange 1008 and is disposed on the bottom surface of the top flange 1008 such that it is substantially perpendicular to the top flange 1008. In particular, the sealing wall 1102 may be disposed between the outer edge 1090 of the top flange 1008 and the sidewall 1005 of the housing cover 202. The sealing wall 1102 may comprise two segments that may be separated into by two openings in between the two segments of the sealing wall 1102. One segment of the sealing wall may be larger than the other and may be shaped like a horseshoe.

Furthermore, as illustrated in FIGS. 10 and 11, the housing cover 202 may include a pair of mounting hole and slot assemblies that are formed in the base 1002 of the housing cover 202 and disposed substantially opposite to each other. Each mounting hole and slot assembly may include a mounting through slot 1014 that is disposed adjacent a mounting through hole 1012. The bottom surface of an area 1116 surrounding the mounting through hole 1012 may be indexed (slightly recessed) to receive a spring clip member 302. The indexed area 1116 may further include coupling openings 1018 that are configured to receive fasteners therethrough to couple the spring clip member 302 to the bottom surface of the base 1002 of the housing cover 202.

Figure 13:
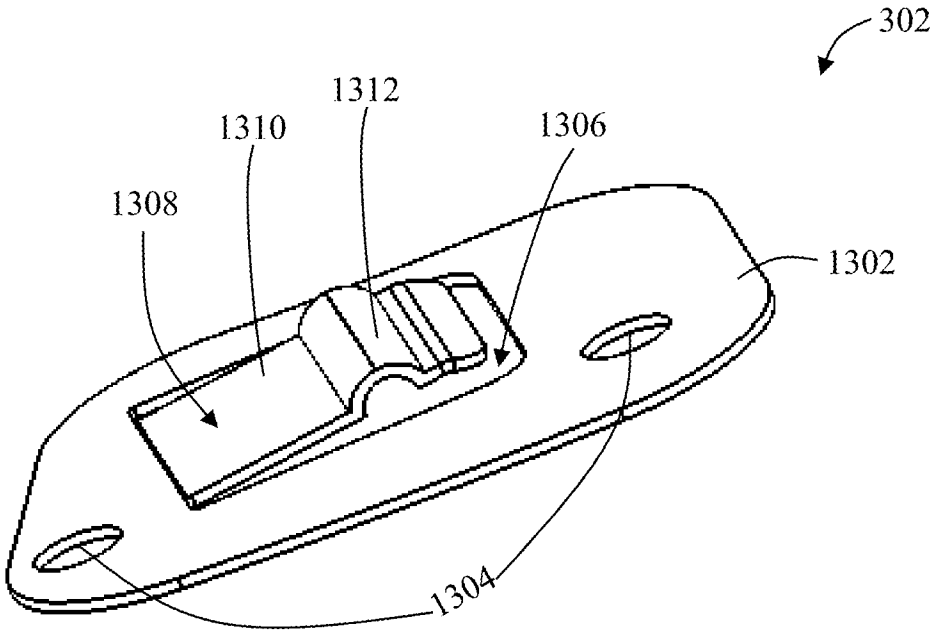
FIG. 13 illustrates a perspective view of a spring clip member of the example surface mount luminaire of FIG. 1, in accordance with example embodiments of the present disclosure.

Turning to FIG. 13, the spring clip member 302 may include planar support base 1302 that has a pair of coupling apertures 1302 and a slot 1306 formed therein. Further, the spring clip member 302 may include a spring tab 1308 that is disposed in the slot 1306 and attached to the planar support base 1302 at one edge of the planar support base 1302 that defines the slot 1306. The spring tab 1308 may include a substantially rectangular body 1310 and a head portion 1312 disposed at the end of the body 1310. The spring tab 1308 may be flexible with respect to the planar support body 1302 such that the spring tab 1308 is adjustable from its default position that is illustrated in FIG. 13 when a force is applied, and when the force is removed, the spring tab 1308 returns to its default position.

The spring clip member 302 may be attached to the housing cover 202 by positioning the spring clip member 302 on a bottom surface of the base 1002 of the housing cover 202 such that: (a) the spring tab 1308 extends through the mounting through slot 1012 of the housing cover 202, and (b) the coupling apertures 1302 of the spring clip member 302 are axially aligned with the coupling openings 1018 on the base 1002 of the housing member 202. Further, fasteners may be passed through the axially aligned coupling apertures 1302 of the spring clip member 302 and the coupling openings 1018 in the base 1002 of the housing member 202 to couple the spring clip member 302 to the housing cover 202.

The spring clip members 302 may be configured to receive the locking arms 1410 of a mounting bracket 206 to couple the light fixture 100 to the mounting bracket 206 and thereby mount the light fixture 100 to a mounting surface, such as a ceiling, or a wall. In other words, as illustrated in FIG. 17, the light fixture 100 may be mounted to a mounting surface using a mounting bracket 206. The mounting bracket 206 will be described below in greater detail in association with FIG. 14.

In addition to the light source housing 102 and the housing cover 202, the light fixture 100 may include a first gasket 204 that is disposed on top of the housing cover 202 and a second gasket 306 that is disposed along the sealing wall 1102. The gaskets (204, 306) may be configured to prevent environmental elements such as water, moisture, other appropriate liquids, etc., from entering the outer cavity 702 of the light fixture 100 in which the electrical components 1702 are disposed, thereby protecting the electrical components, preventing hazardous consequences, and prolonging an operational life of the light fixture 100. The gaskets (204, 306) allow the light fixture 100 to be disposed in wet locations without being harmfully affected by the wet location conditions. The term wet location as used herein can include both indoor and/or outdoor locations where water or other liquids can drip, splash or flow onto the electrical components of the light fixture 100. For example, wet locations can include, but are not limited to, open decks, bathroom, stairwells, patios, uncovered porches, exterior walls, gazebos, pergolas, and walkways.

The first gasket 204 may be a ring shaped gasket that has a substantially rectangular cross sectional profile. In particular, the first gasket 204 may be attached to a top surface of the top flange 1008 of the housing cover 202 such that it extends along a perimeter of the housing cover 202. The first gasket 204 may be attached to the housing cover 202 using an adhesive or any other appropriate or similar attachment mechanism. The first gasket 204 may be configured to create an external seal between the housing cover 202, the light source housing 102, and a mounting surface when the light fixture 100 is mounted to the mounting surface. The external seal created by the first gasket 204 may be configured to prevent water or other environmental elements from entering the outer cavity 702 of the light source housing 102 through the housing cover 202 and/or a joint between the housing cover 202 and the light source housing 102 (when housing cover 202 is coupled to the light source housing 102), thereby protecting the electrical components 1702 that are disposed in the outer cavity 702 of the light fixture 100.

Figure 2:
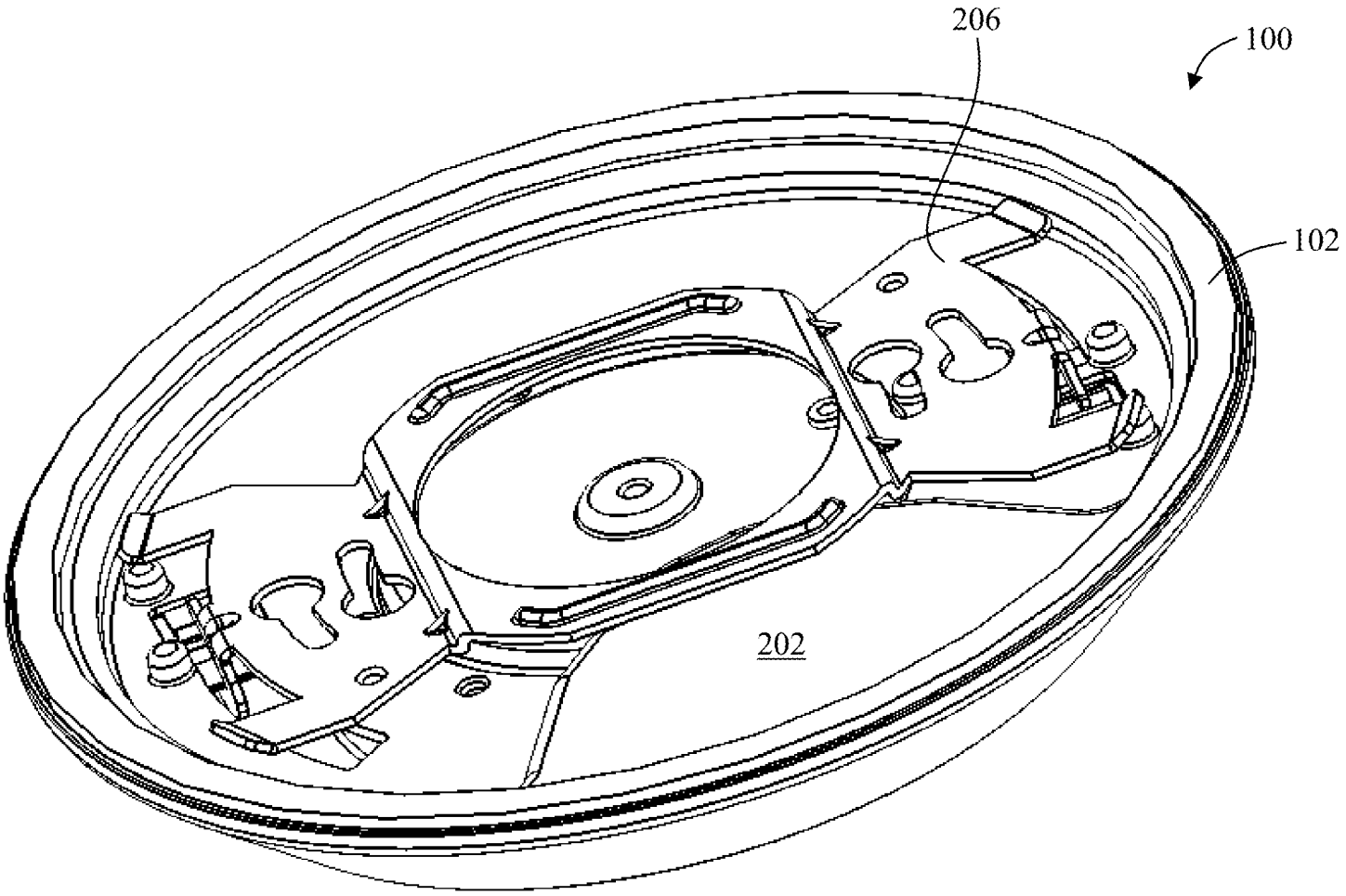
FIG. 2 illustrates another perspective view of the example surface mount luminaire of FIG. 1, in accordance with example embodiments of the present disclosure.

As illustrated in FIGS. 2 and 16, the second gasket 306 may be a ring shaped gasket that has a substantially circular cross sectional profile. The second gasket 306 may be disposed on an outer surface of the sealing wall 1102 of the housing cover 202 such that when the housing cover 202 is coupled to the light source housing 102, the second gasket 306 creates an internal seal that is disposed inside the enclosed outer cavity 702. In particular, the second gasket 306 may be disposed between the sealing wall 1102 and the first surface 696 (outer surface) of the third sidewall 604 of the light source housing 102 to form the internal seal. The internal seal created by the second gasket 306 may be configured to prevent water or any other appropriate environmental elements that enters the outer cavity 702 past the first gasket 204 from progressing any further towards the electrical components 1702 disposed therein.

In other words, the first gasket 204 may create a horizontal seal that restricts a horizontal progression of water or any other appropriate environmental elements into the enclosed outer cavity 702 of the light fixture 100, while the second gasket 306 may create a vertical seal that restricts a vertical/downward progression of the water towards the electrical components 1702 disposed in the enclosed outer cavity 702 of the light fixture 100. For example, when the light fixture 100 is installed in the ceiling and water gets sprayed onto the light fixture 100, the water that reaches the external seal formed by the first gasket 204 may be directed down the light source housing 102 over the second surface 697 (inner surface) of the light source housing 102 without entering the outer cavity 702. If any water enters the outer cavity 702 through the joint between the housing cover 202 and the light source housing 102, the internal seal formed by the second gasket 306 may prevent the water from proceeding any further past the internal seal and towards the electrical components 1702 disposed in the outer cavity 702.

The housing cover 202 may be coupled to the light source housing 102 to form the housing assembly 101 by positioning the housing cover 202 on the light source housing 102 such that: (a) the housing cover 202 encloses the outer cavity 702 defined by the light source housing 102, (b) the component cover 304 that is coupled to the housing cover 202 and the electrical components 1702 disposed in the component cavity 1240 defined by the component cover 304 are disposed in the enclosed outer cavity 702 of the light source housing 102, (c) the top wall 612 of the recessed structure 690 of the light source housing 102 is axially aligned with and extends through the central aperture 1004 defined by the housing cover 202, (d) a portion of the base 1002 of the housing cover 202 is disposed on the first flange 608 of the light source housing 102, and (e) the coupling apertures 1010 (shown in FIGS. 10 and 11) of the housing cover 202 are axially aligned with the second set of coupling apertures 620 on the first flange 608 of the light source housing 102. Then, to securely retain the housing cover 202 to the light source housing 102, fasteners may be passed through the axially aligned coupling apertures (620, 1010) of the light source housing 102 and the housing cover 202. As the housing cover 202 is tightened and securely coupled to the light source housing 102, the second gasket 306 that is positioned on the sealing wall 1102 may engage the first surface 696 (outer surface) of the third sidewall 604 to form the internal seal.

In one or more example embodiments, the light source housing 102 and the housing cover 202 of the housing assembly 101 may be formed using any appropriate material that may be chosen based on UL requirements, e.g., UL wet requirement. The materials may include plastic or any appropriate metals, such as aluminum. In other example embodiments, any other appropriate materials may be used to form the housing assembly 101 (including the component cover 304) for meeting any other appropriate standard and/or cost requirements without departing from a broader scope of the present disclosure.

Mounting the Light Fixture

Figure 14:
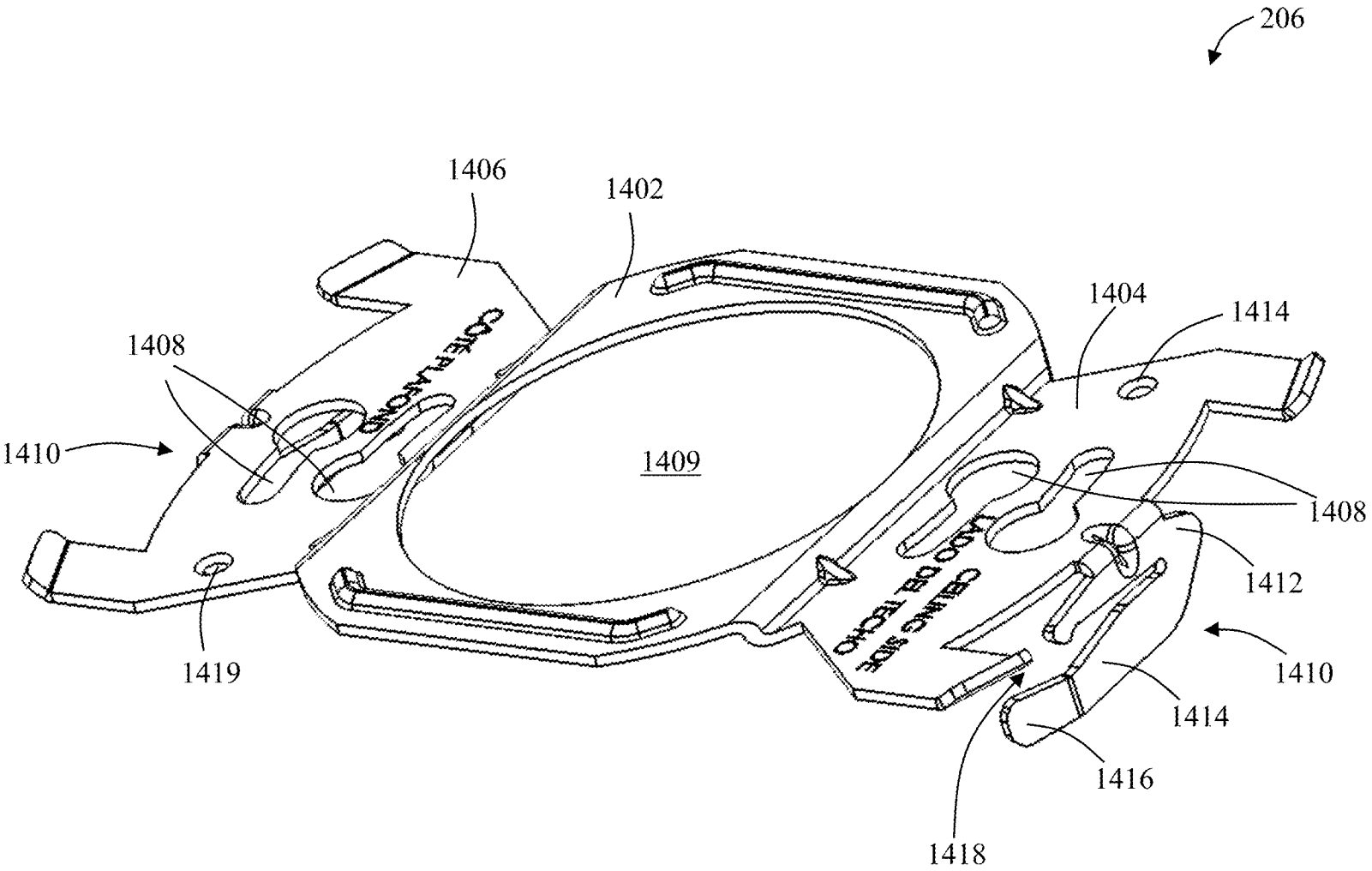
FIG. 14 illustrates a perspective view of a mounting bracket of the example surface mount luminaire of FIG. 1, in accordance with example embodiments of the present disclosure.

As illustrated in FIG. 17, the light fixture 100 may be mounted to a mounting surface 1701, such as a ceiling, using a mounting bracket 206. Turning to FIG. 14, the mounting bracket 206 may be a bow-tie shaped bracket that includes a central segment 1402, a first side segment 1406 disposed on one side of the central segment 1402, and a second side segment 1404 disposed on an opposite side of the central segment 1402. The central segment 1402, the first side segment 1406, and the second side segment 1402 may be integrally formed. The first and second side segments (1404, 1406) may be positioned below and vertically offset from a plane comprising the central segment 1402 such that a plane comprising the central segment 1402 of the mounting bracket 206 may be substantially parallel to a plane comprising the two side segments (1404, 1406) of the mounting bracket 206. In particular, the central segment may define a central aperture 1404. Further, each of the first and second side segments (1404, 1406) may include a coupling aperture 1414 that is configured to receive a fastener therethrough to couple the mounting bracket 206 to a mounting surface. Furthermore, each of the first and second side segments (1404, 1406) may include a pair of junction box coupling apertures 1408 and a locking arm 1410.

The inner junction box coupling apertures 1408 (closest to the central segment 1402 and central aperture 1404) on the two side segments (1404, 1406) may be configured to couple a first junction box having a first diameter to the mounting bracket 206, while the outer junction box coupling apertures 1408 on the two side segments (1404, 1406) may be configured to couple a second junction box having a second diameter to the mounting bracket 206. The second diameter of the second junction box may be larger than the first diameter of the first junction box.

The locking arms 1410 of the mounting bracket 206 may extend substantially perpendicular to the first and second side segments (1404, 1406) from opposite outside edges of the first and second side segments (1404, 1406). The locking arms 1410 on side segments (1404, 1406) may be facing opposite directions. Each locking arm may be substantially U-shaped and may define an clamping opening 1418 therethrough, i.e., between a top arm portion 1412 and a bottom arm portion 1414. The bottom arm portion 1414 may be longer than the top arm portion, and an extension 1416 of the bottom arm portion may be angled upwards and towards the side segment. The clamping opening 1418 may taper from an one end of the locking arm 1410 towards an opposite end.

As illustrated in FIG. 17, the mounting surface 1701 (e.g., a ceiling) may have an opening 1703 formed therein, and the mounting bracket 206 may be mounted to the mounting surface 1701 such that: (a) the side segments (1404, 1406) of the mounting bracket 206 engage and/or rest against the mounting surface 1701, and (b) the central segment 1402 of the mounting bracket 206 is disposed within the opening 1703 in the mounting surface 1701. Fasteners may be passed through the coupling apertures 1414 of the first and second side segments (1404, 1406) of the mounting bracket 206 and the mounting surface 1701 to securely retain the mounting bracket 206 to the mounting surface 1701. Once the mounting bracket 206 is secured to the mounting surface 1701, the light fixture 100 may be coupled to the mounting bracket 206 by a twist lock mechanism.

In particular, the light fixture 100 may be positioned below the mounting bracket 206 such that the locking arms 1410 of the mounting bracket 206 are axially aligned with the mounting through slots 1014 in the housing cover 202 of the light fixture 100. Then, the light fixture 100 may be pushed up towards the mounting bracket 206 such that the bottom arm portion 1414 of each locking arm 1410 passes through the respective mounting through slot 1014 in the housing cover 202 of the light fixture 100 while the top arm portion 1412 of the locking arm 1410 remains above the mounting through slot 1014. Responsively, the light fixture 100 may be twisted till: (a) the locking arms 1410 of the mounting bracket 206 snap onto the spring tabs 1308 of the respective spring clip members 302, and (b) a portion of the base 1002 that separates the mounting through slot 1014 and the mounting through hole 1012 engages the clamping openings 1418 in the locking arms 1410 of the mounting bracket 206 thereby preventing any further rotation of the light fixture 100. When the light fixture 100 is twisted and locked to the mounting bracket 206, the first gasket 204 gets twisted and compressed against the mounting surface 1701 to form the external seal.

The diameter of the housing assembly 101 may be configured such that it conceals the side segments (1404, 1406) of the mounting bracket 206 that engage and/or rest against the mounting surface 1701 when the light fixture 100 is coupled to the mounting bracket 206. Accordingly, once the light fixture 100 is coupled to the mounting bracket 206, only the light source housing 102 and the optical lens 104 may be visible to a user who is looking at the ceiling from below. Further, electrical wires from the junction box that may be coupled to the mounting bracket 206 and disposed behind the mounting surface 1701 are routed to the electrical components 1701 disposed in the enclosed outer cavity 702 through the central opening 618 on the top wall 612 of the light source housing 102.

Even though the present disclosure describes the luminaire as having two different gaskets, one of skill in the art can understand and appreciate that in other example embodiments, the luminaire may include only one of the gaskets without departing from a broader scope of the present disclosure. Alternatively, in other example embodiments, the luminaire may have more than two gaskets. In some embodiments, the luminaire may not include the both the gaskets. Instead, any other appropriate sealing mechanisms may be used. Further, even though the present disclosure describes the lighting assembly as having a reflector, one of skill in the art can understand and appreciate that the reflector may be optional in other example embodiments. Instead, the inner surface of the recessed structure may be made reflective without departing from a broader scope of the present disclosure. Furthermore, even though the present disclosure describes the light fixture as being mounted to the mounting surface by twist locking the light fixture to the mounting structure described herein, one of skill in the art can understand and appreciate that in other example embodiments, any other appropriate mounting mechanism and mounting bracket may be used to mount the light fixture to a mounting surface without departing from a broader scope of the present disclosure.

Although example embodiments are described herein, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A light fixture comprising:

a housing assembly that comprises:

a light source housing having a first surface defining an inner cavity open toward a first direction and a second surface defining an outer cavity open toward a second direction, wherein the first direction is opposite to the second direction, wherein the first surface forms a recessed structure in the light source housing, the recessed structure extending in the second direction, and wherein the recessed structure comprises a wire routing opening for routing electrical wires from the outer cavity to the inner cavity; and a housing cover removably coupled to the light source housing such that the housing cover encloses the outer cavity;

a lighting assembly comprising a light source member and a lens, the lighting assembly being coupled to the first surface of the light source housing and disposed in the inner cavity of the light source housing such that light emitted by the light source member exits the light fixture in the first direction; and one or more electrical components associated with the light fixture, the one or more electrical components mounted on the housing cover and disposed in the outer cavity of the light source housing.

2. The light fixture of claim 1, wherein the recessed structure comprises:

a top wall;

a first sidewall that extends substantially perpendicular to the top wall and in the first direction from a perimeter of the top wall;

a first flange that extends substantially horizontally and radially outward from a first bottom edge of the first sidewall; and a second sidewall that extends substantially perpendicular to the first flange and in the first direction from an outer perimeter of the first flange.

3. The light fixture of claim 2, wherein the light source housing further comprises:

a second flange that extends substantially horizontally and radially outwards from a second bottom edge of the second sidewall; and a third sidewall that extends from an outer perimeter of the second flange to a top edge in the second direction such that the third sidewall forms an obtuse inner angle with the second flange, wherein the second surface of the recessed structure, the second flange and the third sidewall define the outer cavity.

4. The light fixture of claim 1, wherein the housing cover comprises:

a base that is defined by an inner curved edge that defines a central aperture and an outer curved edge that is concentric with the inner curved edge; and a component housing segment.

5. The light fixture of claim 4, wherein the light fixture further comprises a component cover that is removably coupled to the housing cover and configured to house the one or more electrical components.

6. The light fixture of claim 1, further comprising:

a first gasket that is disposed on a first surface of the housing cover such that it extends along a perimeter of the housing cover; and a second gasket that is disposed on a second surface of the housing cover along a sealing wall of the housing cover, the sealing wall being disposed adjacent to and offset from an outer perimeter of the housing cover.

7. The light fixture of claim 2, wherein the lighting assembly further comprises a reflector, and wherein the light source member and the reflector are coupled to the top wall of the recessed structure.

8. The light fixture of claim 2, wherein the top wall comprises the wire routing opening.

9. A light fixture comprising:

a housing assembly that defines a first cavity configured to house one or more electrical components associated with the light fixture, wherein the housing assembly comprises:

a light source housing that comprises:

a base wall defined by an inner edge and an outer edge that is concentric with the inner edge;

a recessed structure extending substantially vertically in a first direction from the inner edge of the base wall such that a first surface of the recessed structure defines a second cavity that is open toward a second direction, the second direction being opposite the first direction, the recessed structure comprising a top wall and a sidewall structure that extends from a perimeter of the top wall to the first inner edge of the base wall; and a light source coupled to the top wall on the first surface of the recessed structure and disposed in the second cavity to emit light in the second direction;

an outer sidewall extending in the first direction from the outer edge of the base wall such that the outer sidewall, the base wall, and a second surface of the recessed structure that is opposite to the first surface define the first cavity; and a housing cover having a central opening through which a portion of the recessed structure extends.

10. The light fixture of claim 9, wherein the sidewall structure of the recessed structure comprises:

a first sidewall that extends substantially perpendicular to the top wall and in the first direction from the perimeter of the top wall;

a first flange extending substantially horizontally and radially outward from a first bottom edge of the first sidewall; and a second sidewall extending substantially perpendicular to the first flange and in the first direction from an outer perimeter of the first flange.

11. The light fixture of claim 9, wherein the housing cover comprises:

a base defined by an inner curved edge and an outer curved edge that is concentric with the inner curved edge; and a component housing segment, wherein the component housing segment is parallel to and vertically offset from a plane comprising the base.

12. The light fixture of claim 11:

wherein the base of the housing cover comprises a pair of first mounting features formed therein, and wherein the pair of first mounting features of the base of the housing cover is configured to engage a pair of second complementary mounting features of a mounting bracket to removably couple the light fixture to the mounting bracket.

13. The light fixture of claim 12:

wherein each first mounting feature of the pair of first mounting features comprise a mounting slot, a mounting hole that is disposed adjacent the mounting slot, and a spring clip member that is coupled to the base such that a spring tab of the spring clip member extends through the mounting hole, and wherein each second complementary mounting feature of the pair of second complementary mounting features comprise a locking arm that is substantially U-shaped.

14. The light fixture of claim 9, further comprising a light source member.

15. The light fixture of claim 9, further comprising a lens.

16. The light fixture of claim 9, further comprising:

a first gasket that is disposed on a first surface of the housing cover and extending along a perimeter of the housing cover; and a second gasket that is disposed on a second surface of the housing cover along a sealing wall of the housing cover, the sealing wall being disposed adjacent to and offset from an outer perimeter of the housing cover.

17. The light fixture of claim 11, wherein the light fixture further comprises a component cover that is removably coupled to the component housing segment of the housing cover such that a component housing cavity is defined by the component cover and the housing cover.

18. The light fixture of claim 9, further comprising a mounting bracket configured to mount the light fixture to a mounting surface.

* * * * *